US005713130A

United States Patent [19]

Fukuda et al.

[11] Patent Number: 5,713,130

[45] Date of Patent: Feb. 3, 1998

[54] PARTIALLY THICK-WALLED ELONGATED METALLIC MEMBER AND METHODS OF MAKING AND CONNECTING THE SAME

[75] Inventors: Akira Fukuda; Kenji Furumi, both of Osaka; Yasuo Watanabe; Susumu Hanyoh, both of Tokyo, all of Japan

[73] Assignees: Daiwa House Industry Co., Ltd., Osaka, Japan; Dai-Ichi High Frequency Co., Ltd., Tokyo, Japan

[21] Appl. No.: 365,638

[22] Filed: Dec. 28, 1994

[30] Foreign Application Priority Data

| | | | |
|---|---|---|---|
| Jan. 24, 1994 | [JP] | Japan | 6-023167 |
| Mar. 4, 1994 | [JP] | Japan | 6-059889 |
| Jun. 14, 1994 | [JP] | Japan | 6-156744 |

[51] Int. Cl.[6] ..... B21K 21/08

[52] U.S. Cl. ..... 29/897.3; 29/525.02; 29/525.11; 29/897.33; 29/897.35; 29/407.05; 72/342.5; 72/342.6

[58] Field of Search ..... 72/342.1, 342.5, 72/342.6; 29/897.3, 897.33, 897.35, 525.02, 525.11, 407.01, 407.05

[56] References Cited

U.S. PATENT DOCUMENTS

| | | | |
|---|---|---|---|
| 3,198,928 | 8/1965 | Allison | 72/342.1 X |
| 3,487,196 | 12/1969 | Bachmann | 72/342.1 X |
| 3,842,644 | 10/1974 | Biesmans | 72/342.1 |
| 4,014,089 | 3/1977 | Sato et al. | 29/525.11 |
| 4,625,533 | 12/1986 | Okada et al. | 72/342.6 X |

FOREIGN PATENT DOCUMENTS

| | | | |
|---|---|---|---|
| 52-470 | 1/1977 | Japan . | |
| 0087943 | 5/1984 | Japan | 72/342.5 |
| 0206134 | 11/1984 | Japan | 72/342.5 |
| 0147140 | 6/1990 | Japan | 72/342.1 |
| 3-212533 | 9/1991 | Japan . | |

*Primary Examiner*—Joseph M. Gorski

*Attorney, Agent, or Firm*—Hamilton, Brook, Smith & Reynolds, P.C.

[57] ABSTRACT

A method of and an apparatus for manufacturing an elongated metallic member (1) having at least one thickened wall area defined at a portion thereof. That portion of the elongated metallic member (1) is heated to a plasticizable temperature to form a heated area (5) while the latter is moved along the metallic member (1) and, at the same time, axially inwardly compressed to allow upsetting at the heated area (5), to thereby form a thickened wall area. A trailing portion (1*a*) of the thickened wall area of the elongated metallic member (1) immediately after the heated area (5) is cooled. The ratio (V/W) of a compressing speed V relative to the moving speed W of the position of the heated area (5) in reference to the thickened portion (1*a*) of the metallic member (1) is progressively increased from a small value, employed at an initial stage of wall thickening, along the metallic member (1) to an aimed value, employed at a steady stage of wall thickening, to thereby progressively increase a wall thickening ratio along the metallic member (1) to a designed value. The subsequent wall thickening is carried out while the ratio is maintained at said designed value for the steady stage of wall thickening. A method of connecting two metallic members (1) in end-to-end fashion and a method of connecting a beam to the metallic member (1) are also disclosed.

10 Claims, 35 Drawing Sheets

PARTIALLY THICK-WALLED ELONGATED METALLIC MEMBER AND METHODS OF MAKING AND CONNECTING THE SAME

BACKGROUND OF THE INVENTION 1. (Field of the Invention)

The present invention relates to a method of making a partially thick-walled elongated metallic member such as, for example, a steel pipe having at least one portion formed with a thickened wall area, and also to a method of connecting another elongated member to the partially thick-walled elongated metallic member.

2. (Description of the Prior Art)

Elongated metallic members such as, for example, steel pipes or tubes, having an uniform cross-section over the entire length thereof are generally used as columns and/or beams in architectural constructions. Where the elongated metallic member having an uniform cross-section over the entire length thereof is to be used as a column, it is a general practice to use reinforcement members at various portions of the elongated metallic member where beams are connected. By way of example, where a steel pipe and an H shape or wide flange shape steel are employed for the column and the beam, respectively, it is a general practice to use reinforcement diaphragms inside the hollow of the column at respective locations each corresponding to the position where the beam is secured and/or to use reinforcement metal pieces around the outer peripheral surface of the column. There are some cases in which a joint between the column and the beam is constituted by a joint box. Where the column is in the form of an H shape steel, it is often practiced to use metal pieces such as reinforcement plates or angle members in the form as interposed between opposite flanges of the H shape steel column at respective locations spaced a distance corresponding to the span between the upper and lower flanges of the beam.

In the structure wherein the reinforcement members are used, the number of construction steps is increased.

Also, where the reinforcement diaphragms are to be disposed inside the column, the position where they are disposed is limited to regions of the column accessible to a worker, for example, end portions of the column, and therefore, this makes it difficult to use a one-pieced skeleton column of a length sufficient to extend through a plurality of stories of a building. For this reason, the column for use in a multi-story building is generally employed in the form of a multi-pieced column consisting of a plural unit columns connected each other at their ends.

To solve these problems, attempts have been made to provide a square steel pipe column with a thickened wall area at the portion where a beam is to be connected. In this example, the thickened wall area is of a design thickening inwardly to the hollow of the square steel pipe column and substantially imparts an increased wall thickness to a localized portion of the square steel pipe column. When in use, the thickened wall area in the square steel pipe column is formed with a plurality of inwardly threaded holes and the beam having an end plate is connected to the square steel column with the end plate bolted to the thickened wall area thereof by means of outwardly threaded bolts. This is disclosed in, for example, the Japanese Laid-open Patent Publication No. 3-212533. However, this patent publication does not disclose any method to provide such column with the thickened wall area, and it has been found that integral formation of the thickened wall area in a localized portion of the steel pipe column in a state of continuously stretching to non-thickened wall area, according to the known method is extremely difficult.

The inventors of the present invention have conducted a series of studies in an attempt to provide a solution to the above discussed problems inherent in the prior art and has successfully developed, as a means for integrally forming the thickened wall area in the localized axial portion of the elongated metallic member, such an apparatus as shown in FIG. 35 and disclosed in the Japanese Examined Patent Publication No. 52-470.

Referring to FIG. 35, the wall-thickening apparatus shown therein is so designed that a tubular metallic member 1 having at least one portion of the wall thereof desired to be thickened circumferentially thereof over a desired distance in an axial direction thereof is clamped at one end by a tailstock 2 and also at the opposite end drivingly coupled with a pusher 3 through a clamp. The pusher 3 includes a fluid-operated cylinder for driving the pusher 3 so as to apply an axially inwardly acting pushing force to the tubular metallic member 1. While the tubular metallic member 1 is axially inwardly compressed, a localized portion of the tubular metallic member 1 is successively heated by a heating unit 4 such as, for example, an annular high frequency induction coil, to heat that portion of the tubular metallic member to a sufficiently high temperature at which the heated wall of the tubular metallic member 1 can be heavily deformed or upsetted, to thereby form the heated area 5. With the heating unit 4 moved in a direction axially of the tubular metallic member 1 at a predetermined speed, the heated area 5 so formed progressively moves as the heating proceeds. Simultaneously with the heating effected by the heating unit 4 being moved, a cooling medium 6 is sprayed from the heating unit towards a portion of the tubular metallic member 1 on a trailing side, i.e., rearwardly, of the heated area 5 with respect to the direction of movement of the heating unit 4 to cool and solidify a heated area of the tubular metallic member 1 to process successive formation of the thickened wall area in the tubular metallic member which extends a predetermined or required distance in a direction axially of the tubular metallic member 1.

It has, however, been found that such wall-thickening process disclosed in the above mentioned patent has the following problem. Specifically, although the prior art wall-thickening apparatus is effective to attain a wall thickening ratio, i.e., the ratio of an added thickness $t_1-t_0$ to an original thickness $t_0$, up to 20%, irregular wall thickening related to an axial inward buckling of the heated area of the tubular metallic member 1 tend to be formed as shown in FIG. 36, especially at an initial stage of wall thickening if an attempt is made to obtain a wall thickening ratio greater than 20%.

Moreover, once said irregularities are formed, heating and cooling would not be Satisfactorily effected to the heated area of the tubular metallic member 1, resulting in cyclic formation of the thickness irregularities in the thickened wall area of the tubular metallic member 1, causing the thickened wall area 1*a* to represent the shape similar to a bellows and, therefore, the tubular metallic member 1 can be no longer useable in practice. Therefore, with the prior art wall thickening apparatus discussed above, the wall thickening of a ratio greater than 20% is impossible. On the other hand, when the elongated metallic member having the thickened wall area so formed is used as a column and a beam is desired to be connected at one end to such thickened wall area of the elongated metallic member, the thickened wall area should preferably be formed to the wall thickening ratio greater than 20%, and more preferably within the range of 40 to 300%.

As discussed hereinabove, with the prior art wall thickening process, it is not possible to form the thickened wall area having the desired ratio of wall thickening uniformly over the length thereof.

Also, with the elongated metallic member prepared by the prior art wall-thickening process, it has been found that a steep step tends to be formed at the boundary between the thickened wall area and the non-thickened wall area of the elongated metallic member. For this reason, even though the wall of that portion of the elongated metallic member is successfully formed to exhibit the ratio of wall thickening in excess of 20%, stress concentration tends to occur at the step between the thickened wall area and the non-thickened wall area when a bending moment is effected on the elongated metallic member, resulting in reduction in strength.

SUMMARY OF THE INVENTION

The present invention is accordingly intended to provide an improved method of making a partially thick-walled elongated metallic member having at least one thickened wall area free from aforementioned irregular wall thickening and having a sufficient ratio of wall thickening and also to provide an improved method of connecting another elongated member to the partially thick-walled elongated metallic member.

To this end, the present invention provides a method for manufacturing an elongated metallic member having at least one thickened wall area defined at a portion thereof. That portion of the elongated metallic member is heated in the heating zone, to a temperature suitable for upsetting to thereby form a heated area on the metallic member while the position of the heated area is moved lengthwise along the elongated metallic member and, at the same time, axially compressed to allow the metallic member to upset to thereby form a thickened wall area. A thickened side of the heated area is cooled successively to solidify to freeze said thickened state. The ratio (V/W) of a compressing speed V, at which a heated area of the metallic member is axially compressed to a relative moving speed W of the position of the heated area in reference to the thickened side of the metallic member is gradually increased to the aimed value, at an initial stage of wall thickening, to thereby gradually increase the wall thickening ratio along the metallic member to the designed value. The subsequent upsetting is constantly carried out while said V to W ratio is maintained at said value for the steady stage of wall thickening to the uniform thickness as designed.

According to the method of the present invention, the elongated metallic member having at least one thickened wall area of a sufficient wall thickening ratio on an axial portion thereof can easily and readily be manufactured, especially by the use of the gradual change in V to W ratio, i.e., wall thickening ratio in the initial stage. Furthermore, the partially thickened metallic member, produced by the present invention, has no notch, so aforementioned stress concentration cannot be caused.

According to a first method of connecting a column and a beam together, the use has been made of the elongated metallic member prepared by the method of the partially thick-walled elongated metallic member of the present invention. In the practice of this method, the elongated metallic member is used as the column having the thickened wall area in an axial portion thereof, and the beam is bolted at one end to the thickened wall area by the use of bolts.

This first connecting method is advantageous in that the beam can be firmly connected to the thickened wall area of the column with no reinforcement member required. For this reason, the number of the bolts used to connect the column and the beam together can advantageously be reduced, accompanied by reduction in number of bolt fastening procedures.

According to a second method of connecting a column and a beam together, the use has been made of the elongated metallic member prepared by the method of the partially thick-walled elongated metallic member of the present invention. In the practice of this method, the elongated metallic member is used as the column having the thickened wall area in an axial portion thereof, and the beam is welded at one end to the thickened wall area by the use of any known welding technique.

This second connecting method is advantageous in that since the thickened wall area of the column provides a location to which the beam is welded, the column and the beam can be firmly connected together with no need to use any reinforcement member. For this reason, the procedure to connect the column and the beam can be simplified.

The present invention also provides a method of connecting at least two steel pipes together in end-to-end fashion. In the practice of this end-to-end connecting method, each of the two pipes is employed in the form of the elongated metallic member prepared according to the method of making the partially thick-wailed elongated metallic member of the present invention and has one end formed with the thickened wall area. While the pipes are held in end-to-end abutment with the respective thickened wall areas adjoining with each other, a connecting member is disposed so as to straddle between the thickened wall areas, and is then bolted to the thickened wall areas to complete the intended end-to-end connection of the two pipes.

Since the respective ends of the two pipes are defined by the thickened wall areas, a sufficient sectional strength can be secured even though bolt holes are formed in each of the thickened wall area, and a firm end-to-end connection is possible.

The present invention furthermore provides a second method of manufacturing an elongated metallic member which may be used as an architectural skeleton column of a length sufficient to extend through a plurality of stories of a building. This second method includes the step of forming a plurality of thickened wall areas in the elongated metallic member and spaced a distance from each other in a direction lengthwise thereof.

The present invention provides the elongated metallic member manufactured by the second method referred to above. The elongated metallic member so manufactured is characterized in that each of the thickened wall areas has a wall thickness which is 1.2 to 3.6 times the thickness of a non-thickened wall area of the elongated metallic member and also has an axial length which is 1.1 to 4.0 times an outer lateral dimension of the non-thickened wall area of the elongated metallic member and that each of the thickened wall areas has opposite ends continued to and inclined at an angle of 5° to 45° relative to the non-thickened wall areas of the elongated metallic member.

According to the second method referred to above, the resultant elongated metallic member has a plurality of thickened wall areas over the length thereof and has an increased strength at each of the thickened wall areas. Accordingly, if the thickened wall areas are used for connection with respective beams which may define floor beams of a building, each beam can firmly be connected to the associated thickened wall area with no need to use any back-up and/or reinforcement members or with the use of relatively thin reinforcement members, by means of a simplified connecting procedure. Moreover, if the resultant elongated metallic member is used as the architectural skeleton column of a length sufficient to extend through the stories of the building, no procedure which, when the column is composed of a plurality of column segments, would be required to connect those column segments together in end-to-end fashion to complete a single column is needed, rendering the construction of the building to be simplified.

Moreover, the elongated metallic member prepared by the second method referred to above may be equally used in the practice of any one of the first and second beam-to-column connecting methods and the end-to-end connecting method discussed above.

The present invention yet provides a third method of manufacturing an elongated metallic member having at least one thickened wall area defined at a portion thereof. This third method comprises of heating said portion of the elongated metallic member to a temperature suitable for upsetting or heavy deformation, to thereby form a heated area on the metallic member; moving the position of the heated area along the metallic member and axially compressing the metallic member to allow the metallic member to be upset at the heated area to thereby form a thickened wall area; cooling a trailing portion of the heated area of the metallic member successively, thereby processing the thickened wall area; detecting a displacement of the heated area of the metallic member relative to a longitudinal axis thereof in a direction perpendicular to such longitudinal axis; applying a load or a bending moment to the elongated metallic member so as to angularly move the elongated metallic member in a direction counter to the direction in which the heated area of the metallic member has displaced, to thereby minimize the displacement; and continuing a wall thickening while the displacement of that heated area of the elongated metallic member is maintained within a predetermined tolerance.

According to the third manufacturing method, when as a result of thermal stresses induced within the cross-section of that heated area of the elongated metallic member and its vicinity, that heated area of the elongated metallic area and its vicinity displace laterally relative to the longitudinal axis of the elongated metallic member, such displacement can be detected so that the load or bending moment corresponding to the detected magnitude of lateral displacement is applied to that heated area of the elongated metallic member to thereby rectify a bending of the elongated metallic member into the right position. Thus, the displacement of that heated area of the .elongated metallic member and its vicinity can advantageously be kept within an aimed tolerance, making it possible to provide the elongated metallic member substantially free from misalignment.

The elongated metallic member prepared by the third manufacturing method referred to above may also be equally used in the practice of any one of the first and second beam-to-column connecting methods and the end-to-end connecting method discussed above.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE PREFERRED EMBODIMENTS

Figure 2:
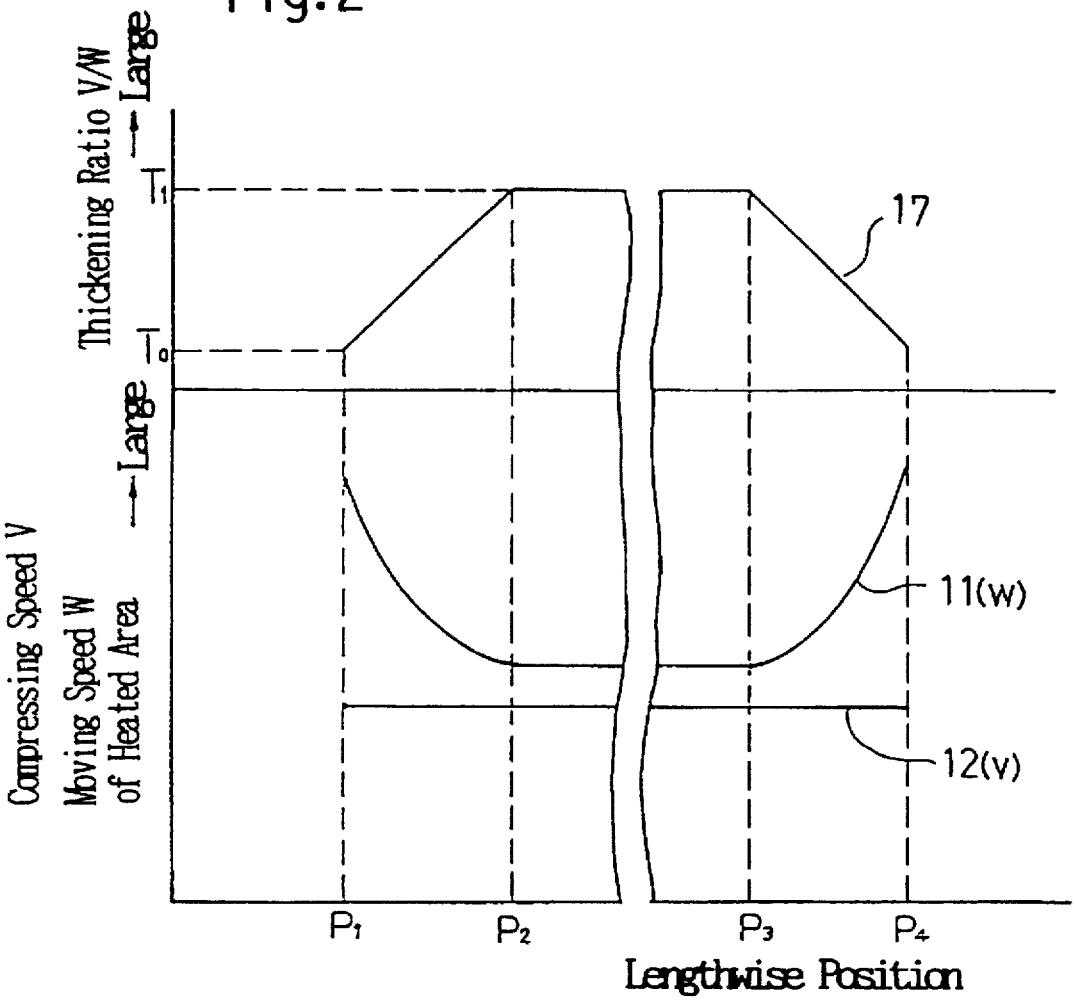
FIG. 2 is a graph showing a different relationship between the compressing speed V, the moving speed of the heated area and the ratio V/W.
Figure 3:
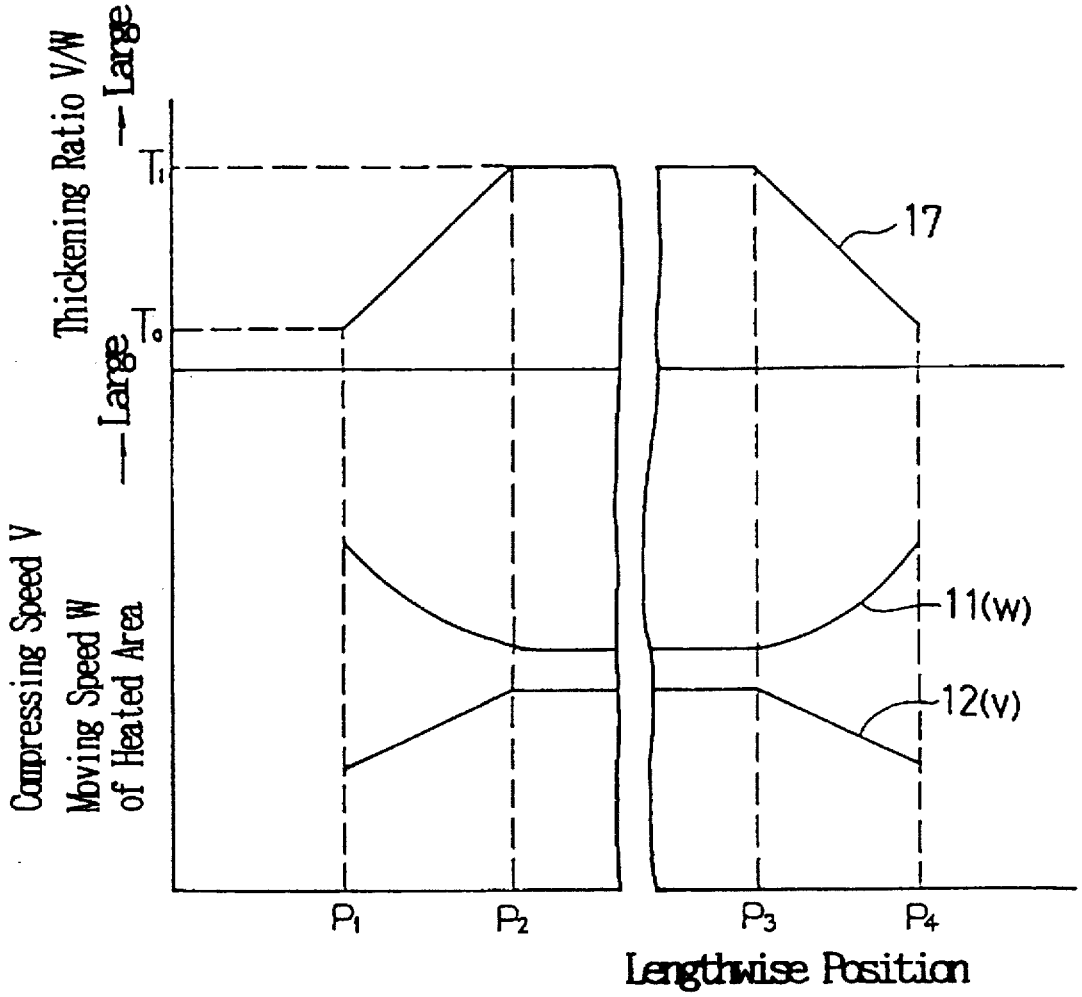
FIG. 3 is a graph showing a further different relationship between the compressing speed V, the speed W of movement of the heated area and the ratio V/W.
Figure 4:
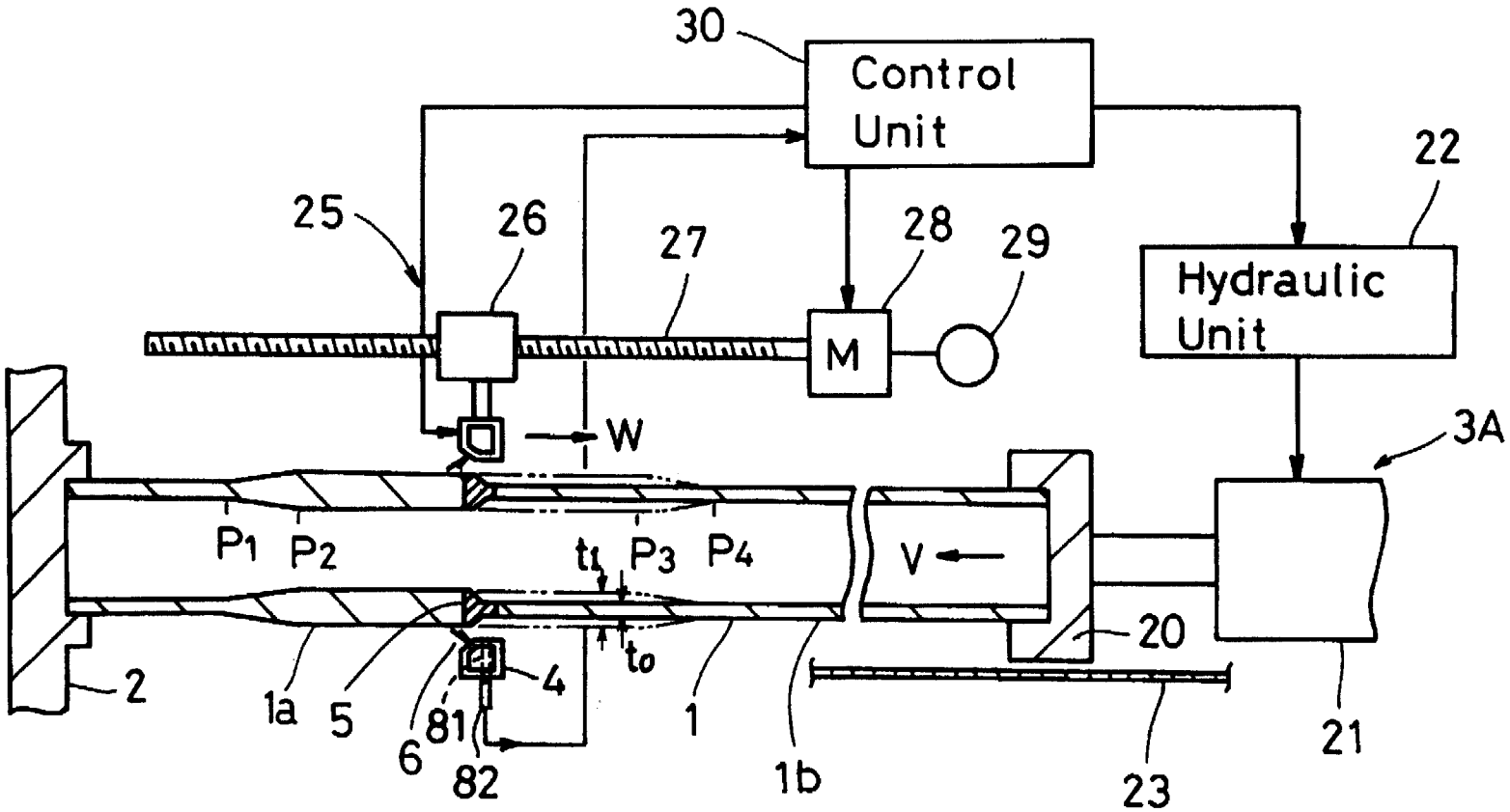
FIG. 4 is a schematic sectional view illustrating an example of a wall-thickening apparatus utilized in the practice of a method of manufacturing a partially thick-wailed tubular metallic member according to a first preferred embodiment of the present invention.
Figure 35:
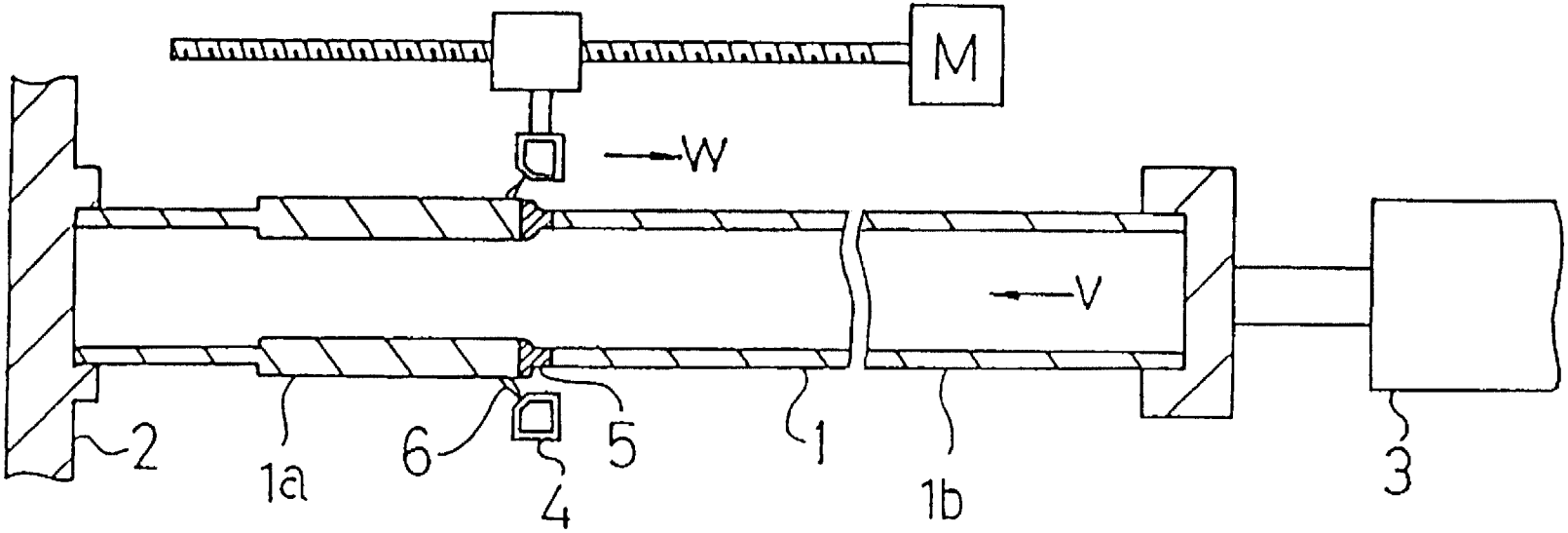
Fig. 35 Prior Art
FIG. 35 is a longitudinal sectional view of the prior art wall thickening apparatus used in the practice of the prior art method of making the elongated metallic member.

A first preferred embodiment of the present invention is shown in FIGS. 1 to 6. Of them, FIG. 4 is a schematic sectional view illustrating an example of a wail-thickening machine utilized in the practice of a method of manufacturing a partially thick-walled tubular metallic member according to a first preferred embodiment of the present invention. It is to be noted that component parts of the wall-thickening machine shown in FIG. 4, which are similar to those of the prior art wall-thickening machine shown in FIG. 35, are identified by like reference numerals used in FIG. 35.

Referring first to FIG. 4, a tubular metallic member 1 having at least one portion of the wall thereof desired to be thickened circumferentially thereof over a desired distance in an axial direction thereof may be a tubing such as a round pipe, a square pipe (square tube), a rectangular pipe (rectangular tube) or the like. The tubular metallic member 1 has an trailing portion 1*a* and a leading portion 1*b* that are defined on respective sides of a heated area 5 with respect to the direction of advance of the heated area 5. This tubular metallic member 1 is supported in the wall-thickening machine with a first end thereof adjacent the trailing portion 1*a* fixedly retained by a tailstock 2 and also with the opposite second end thereof adjacent the leading portion 1*b* drivingly coupled with a pusher 3A. The pusher 3A includes a clamp 20 for holding the second end of the metallic member 1, a fluid-operated cylinder 21 for reciprocately driving the clamp 20 between pushed and retracted positions in a direction axially of the metallic member 1, a hydraulic unit 22, and a compression detector 23 for detecting the position to which the clamp 20 has been driven. The hydraulic unit 22 includes a servo valve for controlling the flow of a fluid medium to be supplied to the fluid-operated cylinder 21 and a control unit for controlling the servo valve so that, under the control of the servo valve, the position of and the moving speed of the clamp 20 relative to the metallic member 1 can be adjusted as desired. It is to be noted that, in place of the use of the fluid-operated cylinder 21, a screw-type press or any other suitable mechanism including a drive motor and a drive chain may be employed for driving the clamp 20 then holding the metallic member 1.

The wall-thickening machine includes a heating unit 4 of a generally ring-shaped configuration sufficient to encircle the metallic member 1. This heating unit 4 is operable to axially progressively heat a localized axial wall portion of the metallic member 1 to a temperature suitable for upsetting, i.e., a temperature at which the heated wall of the metallic member 1 can undergo a heavy deformation, to thereby form the heated area 5 that progressively moves in a direction axially of the metallic member 1 as the heating proceeds. In this embodiment so far illustrated, the heating unit 4 makes use of a high frequency induction coil assembly, but a laser heating unit utilizing a laser beam may be employed if so desired. In any event, this heating unit 4 has a coolant passage defined therein for the flow of a cooling medium 6 such as, for example, a cooling water, and also has at least one circumferential row of jet nozzles from which the cooling medium 6 is sprayed towards a trailing wall portion of the metallic member 1 with respect to the direction of movement of the heated area 5.

The heating unit 4 includes a radial passage 81 defined therein so that a temperature sensor 82 positioned outside the heating unit 4 in the vicinity of a radial outer opening of the radial passage 81 can detect the temperature of the heating area 5. A temperature signal outputted from the temperature sensor 82 and indicative of the temperature of the heating area 5 is supplied to the control unit 30. The temperature sensor 82 employed in the practice of the present invention may be a non-contact temperature sensor such as an infrared sensor.

The heating unit 4 is supported for movement in a direction axially of the metallic member 1 by a heater drive unit 25 which includes a carriage 26 fixedly carrying the heating unit 4, a screw shaft 27 having the carriage 26 mounted thereon and operable to drive the carriage 26 therealong during rotation thereof about the longitudinal axis thereof, a drive motor 28 for driving the screw shaft 27, and a heater position detector 29 for detecting the position of the carriage 26 along the screw shaft 27 in terms of the angular position of the drive motor 28, that is, the position of the heating unit 4 with respect to the lengthwise direction of the metallic member 1. The drive motor 28 used herein is a speed-controllable electric motor and, therefore, by controlling the speed of rotation of the drive motor 28, the moving speed of the heating unit 4 along the screw shaft 27 can be adjusted.

The carriage 26 incorporates therein an electric power supply unit (not shown) for supplying an electric .power to the heating unit 4. This electric power supply unit is of a design capable of controlling the effective quantity of heat which the heating unit 4 applies per unitary time to the heated area 5 of the metallic member 1. The wall-thickening machine shown in FIG. 4 is controlled by a control unit 30 which is so programmed and so operable as to render the compressing speed V, that is, the speed at which the metallic member 1 is axially inwardly compressed by the pusher 3A, and the moving speed W of the heating unit 4 driven by the heater drive unit 25, that is, the moving speed of the heated area 5 relative to that thickened portion 1*a* of the metallic member 1 which is positioned rearwardly of the heated area 5 with respect to the direction of advance of the heated area 5, to vary according to predetermined respective characteristic curves that are programmed in the control unit 30.

A method of manufacturing a partially thick-walled metallic member 1 according to the first preferred embodiment of the present invention, which is practiced by the use of the wall-thickening machine of the above described construction, will now be described. Let it be assumed that an axial region of the metallic member 1 delimited between points P1 and P4 shown in FIG. 4 is where the wall of the metallic member 1 is desired to be thickened and that an axial intermediate region between points P2 and P3 encompassed between the points P1 and P4 is where the wall of the metallic member 1 attains a predetermined or desired uniform thickness while the wall thickness of the metallic member 1 gradually increases and decreases at an axial trailing region delimited between the points P1 and P2 and an axial leading region delimited between the points P3 and P4 respectively, with respect to the direction of advance of the heating unit 4.

Figure 1:
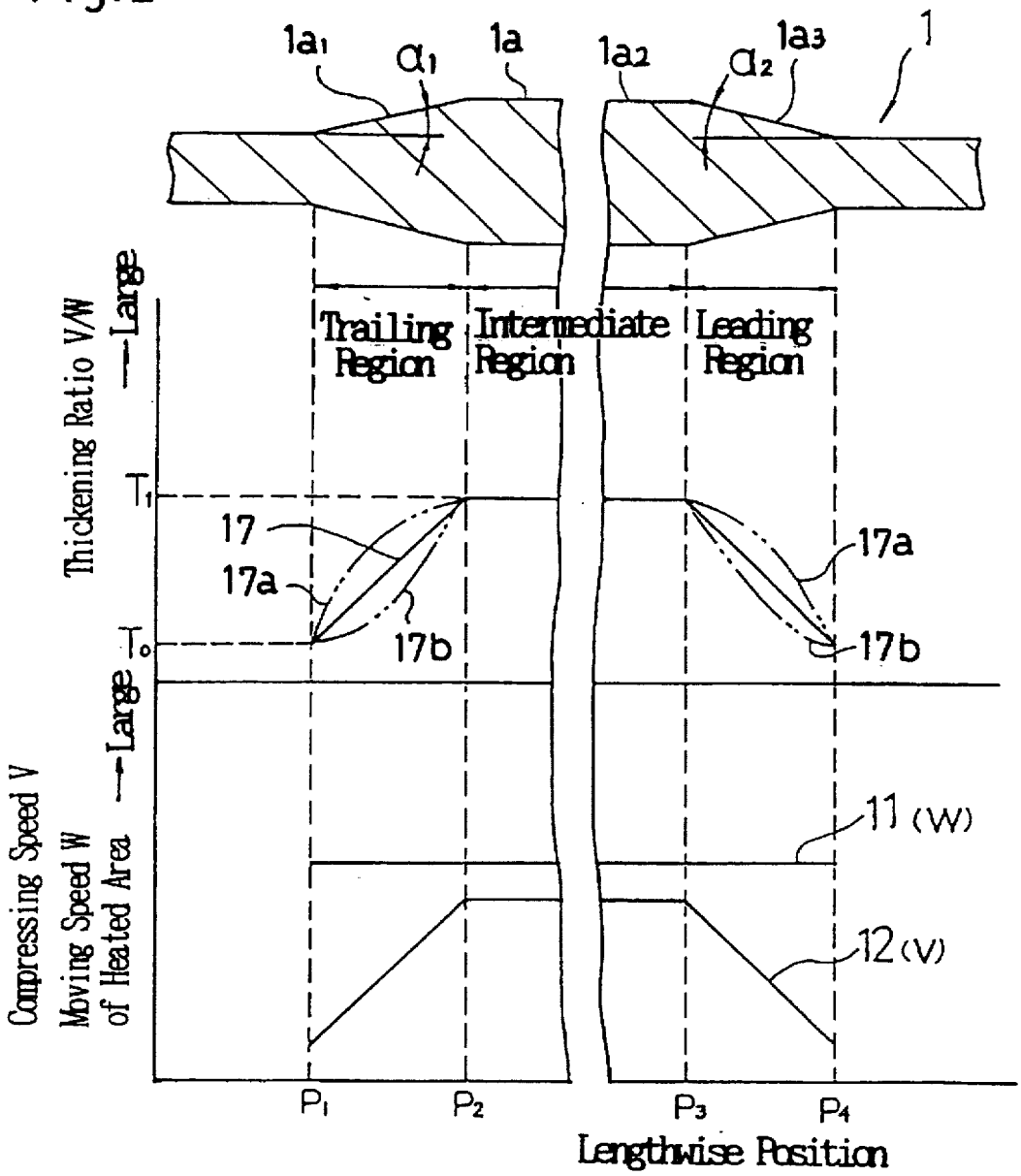
FIG. 1 is a graph showing the relationship between the wail thickening ratio, or the V to W ratio, of an elongated metallic member obtained by the first manufacturing method of the present invention, the compressing speed V and the moving speed W of a heated area.

Before the wall-thickening is initiated from the point P1, predetermined characteristic curves such as indicated by 11 and 12 in FIG. 1 which are descriptive of the compressing speed V, at which the metallic member 1 is axially inwardly compressed by the pusher 3A, and the moving speed W of the heated area 5 relative to the trailing portion 1*a* of the metallic member 1 with respect to the lengthwise direction thereof are programmed in the control unit 30 shown in FIG. 4. Also, a predetermined characteristic curve descriptive of the effective quantity of heat supplied from the heating unit 4, shown in FIG. 4, to the heated area 5 is programmed in the control unit 30 so that the ratio between an effective unit time heat supply amount Q (or the effective quantity of heat supplied from the heating unit 4 to the heated area 5 per unitary time) and the moving speed S (=V+W) of the heated area 5 relative to the leading (or unthickened) portion 1*b* of the metallic member 1 positioned on a leading side with respect to the heated area 5 attains a constant value.

The term "effective unit time heat supply amount" referred to hereinabove and hereinafter is intended to mean the amount of heat actually supplied from the heating unit 4 towards the heated area 5. This heat supply amount is in practice measured by the electric power supplied from an energy source (not shown) to the heating unit 4.

After the control unit 30 has been so programmed, the heating unit 4 is set in position in alignment with the point P1 and is then electrically powered to initiate heating of the metallic member 1. At the same time, the metallic member 1 is axially inwardly compressed by the pusher 3A with the clamp 20 moving from the retracted position towards the pushed position to allow the heated area 5 to undergo a plastic deformation in a direction across the wall thickness to thereby increase the wall thickness of that portion of the metallic member 1 being heated. Simultaneously with or shortly after the start of heating, the heating unit 4 is driven by the drive motor 28 axially of the screw shaft 27 to progressively move the heated area 5 along the lengthwise direction of the metallic member 1. Again, simultaneously with or shortly after the start of heating, a portion of the metallic member 1 on the trailing side of the heating unit 4 is cooled by the cooling medium 6, discharged from the jet nozzles, to suppress an excessive increase of the wall thickness of that portion of the metallic member 1. In this way, the wall-thickening is carried out continuously in a direction lengthwise of the metallic member 1.

During the wall-thickening process taking place in the manner as hereinabove described, the control unit 30 controls the pusher 3A and the drive motor 28 to render the compressing speed V and the moving speed W of the heated area 5 to follow the respective characteristic curves 11 and 12 shown in FIG. 1 which have been programmed in the control unit 30 as hereinabove described. Accordingly, the ratio V/W of the compressing speed V relative to the moving speed W of the heated area 5 varies as shown by a characteristic curve 17 in FIG. 1 which represents that the wall thickness gradually increases during the initial movement of the heated area 5 over a distance corresponding to the axial trailing region between the points P1 to P2, attains a constant value during the subsequent movement of the heated area 5 over a distance corresponding to the axial intermediate zone between the points P2 and P3 and finally gradually decreases during the final movement of the heated area 5 over a distance corresponding to the axial leading zone between the points P3 and P4. Also, during the wall-thickening process taking place, the control unit 30 shown in FIG. 4 controls the heating unit 4 so that the ratio between the effective unit time heat supply amount Q and the moving speed S of the heated area 5 in reference to the leading side 1*b* thereof and equal to the sum of V and W, i.e., V+W, may attains a predetermined constant value, and accordingly, the temperature at the heated area 5 is maintained at an aimed value.

The heated area 5 of the elongated metallic member 1 exhibits a constant resistance to deformation when heated to a predetermined temperature and, therefore, the wall thickening ratio can be controlled as desired. Where the moving speed S is relatively high, the temperature of the heated area 5 can be maintained at the constant value by rendering the ratio between the effective unit time heat supply amount Q and the speed S of movement to be constant. On the other hand, where the moving speed S is low, the conductivity of heat from the heated area 5 towards the leading portion 1*b* of the metallic member 1 increases to such an extent as to spoil the above discussed proportionality. In such case, control of the heating unit 4 by the control unit 30 in response to the temperature signal from the temperature sensor 82 so as to render the temperature of the heated area 5 of the metallic member 1 to be at the predetermined constant value is effective to modify the effective unit time heat supply amount Q.

Thus, at the axial trailing region between the points P1 and P2, the degree of wall thickening, that is, the extent to which the wall of the metallic member 1 is increased in the radial direction thereof, increases progressively; at the axial intermediate region between the points P2 and P3, the degree of wall thickening is maintained at a predetermined value; and finally, at the axial leading region between the points P3 and P4, the degree of wall thickening decreases progressively. In this way, as shown in FIG. 1, the wall of a trailing portion $1a_1$ of the metallic member 1 corresponding to the axially trailing region has a wall thickness progressively increasing while forming a gentle gradient to the predetermined wall thickness which is subsequently represented by the wall of an intermediate portion $1a_2$ of the metallic member 1 corresponding to the axially intermediate region over the entire length of such intermediate portion $1a_2$ which is in turn followed by the wall of a leading portion $1a_3$ of the metallic member 1 corresponding to the axially leading region and having a wall thickness progressively decreasing while forming a gentle gradient. According to the illustrated embodiment, during the wall thickening process, no abrupt change in degree of wall thickening occurs.

It is to be noted that during the wall thickening at the axially trailing region, since as shown in FIG. 5(A) in an exaggerated form the cooling medium 6 is sprayed towards the gently inclined outer surface of that trailing portion $1a_1$ of the metallic member 1, the sprayed cooling medium 6 smoothly flows therealong to achieve a stabilized cooling effect. In this way, the stabilized wall thickening can advantageously be accomplished partly because the moderate increase of the wall thickening ratio and partly because of the positive cooling that takes place immediately after the wall thickening, and it is therefore possible to attain 100% or higher wall thickening ratio.

In the above mentioned thickening process, it is to be noted that the wall thickness is increased or decreased gradually in the initial or final stage of wall thickening, respectively. The reason why the wall thickness can be changed gradually can be explained as follows.

Figure 5:
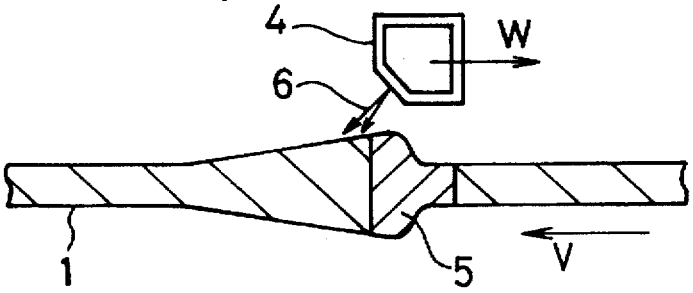
FIG. 5(A) is a fragmentary sectional view, on an enlarged scale, of the elongated metallic member having its wall portion increased in thickness by the apparatus shown in FIG. 4.
FIG. 5(B) is a schematic diagram showing the principle of wall thickening based on the upsetting process of the present invention.
Figure 5B:
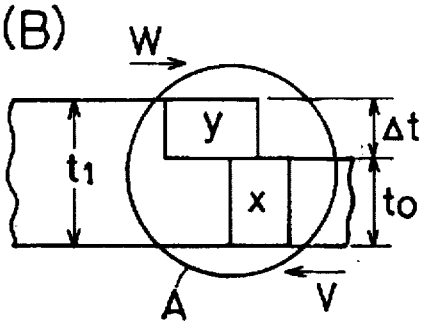

As described in FIG. 5(B), the volume of the metallic member, pushed into the upsetting area A is identified as $x=V\times t_0$. In the same way, the amount that is needed to form the thickened portion is expressed as $y=W\times\Delta t$. As the volume x converts to the volume y quantitatively, so, the relationship $V\times t_0=W\times\Delta t$ is obtained. Thus, wall thickening ratio $\Delta t/t_0$ equals to V/W ($\Delta t/t_0=V/W$), that is aforementioned.

In the initial stage of the wall thickening, said V/W ratio is increased gradually, so that the ratio $\Delta t/t_0$ is increased gradually in proportion. Also, in the final stage $\Delta t/t_0$ is gradually decreased, corresponding to the gradual decrease of V to W ratio.

Figure 36:
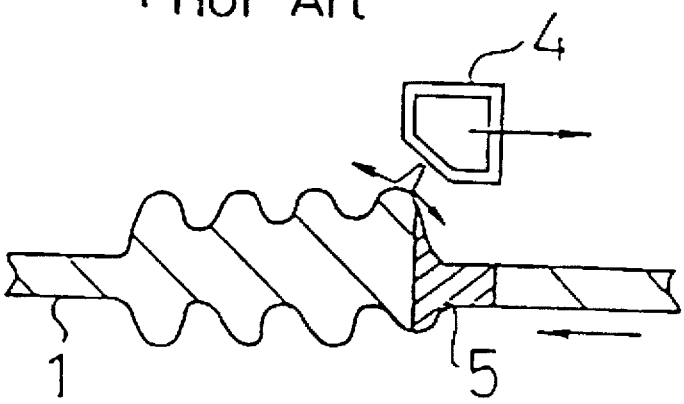
Fig. 36 Prior Art
FIG. 36 is a sectional view of a portion of the elongated metallic member according to the prior art method, showing formation of an irregularly thickened wall area of the elongated metallic member.

Since the irregular wall thickening is apt to occur at the initial stage of the wall thickening process, gradual increase of the ratio V/W at the initial stage of the wall thickening process is effective to suppress formation of the surface irregularities generated in the prior art as shown in FIG. 36 so that the elongated metallic member 1 exhibiting a satisfactory wall thickening ratio can be manufactured. It is also to be noted that since the metallic member 1 having a localized wall-thickened area as a result of the wall thickening process has gentle gradients $\alpha_1$ and $\alpha_2$ on respective sides of the intermediate portion $1a_2$ as shown in FIG. 1, the metallic member 1 has no portion where stress setup may occur and does, therefore, exhibit a sufficiently reinforced characteristic.

The characteristic curves set in the control unit 30 on the occasion of the wall thickening process to be effected may not be always limited to the characteristic curves 11 and 12 shown in FIG. 1, but may be those shown in FIG. 2 or FIG. 3.

Also, inclination of each of the trailing leading portions $1a_1$ and $1a_3$ of the metallic member 1 on respective sides of the intermediate portion $1a_2$ thereof may not be straight, but may be either convexed or concaved. For this purpose, arrangement may be made that the degree of wall thickening is varied from the characteristic curve 17 shown in FIG. 1 to either a characteristic curve 17*a* or a characteristic curve 17*b*. Alternatively, in order to vary the degree of wall thickening, arrangement may be made either that only the compressing speed V is varied or that both of the compressing speed V and the moving speed W of the heated area 5 are varied to achieve the desired degree of wall thickening.

While in the foregoing embodiment the respective characteristic curves of the compressing speed V and the moving speed W of the heated area 5 have been described as programmed in the control unit 30 to permit the latter to make them the characteristic curves, one of the respective characteristic curves of the compressing speed V and the moving speed W of the heated area 5 together with the ratio V/W may be programmed in the control unit 30 so that, by measuring on a real-time basis either the compressing speed V or the moving speed W of the heated area 5 at which the machine is driven, the other of the compressing speed V and the moving speed W of the heated area 5 can be controlled according to the measurement so as to allow the ratio V/W to follow a predetermined characteristic curve.

Again, an alternative method may be employed in which by measuring on a real-time basis the compressing speed V employed during the wall thickening process while a predetermined force of compression is constantly applied to the metallic member 1 by means of the pusher 3A, the moving speed W of the heated area 5 may be controlled according to the measurement of the compressing speed V so as to allow the ratio V/W to follow a preset characteristic curve based on the measurement. In such case, the pusher 3A may not be required to have a function of controlling the compressing speed V, but may be employed merely in the form of a hydraulic press.

In FIG. 4, the metallic member 1 has been shown as a round pipe. However, the metallic member 1 utilizable in the practice of the present invention may not be always limited to the round pipe, but may be a square pipe, an H shape or wide flange steel, a channel steel or any other shape metallic member. Where the pipe is desired to be partially wall-thickened, while in FIG. 4 the heating unit 4 is disposed so as to exteriorly encircle the pipe so that heating and cooling are effected externally towards an outer peripheral surface thereof, the heating and cooling may be effected internally towards an inner peripheral surface thereof, or the combination of the external heating with the internal cooling or the internal heating with the external cooling may be employed.

So far as shown in FIG. 4, the heating unit 4 is moved axially of the metallic member 1 in a direction close towards the clamp 20 to form the progressively moving heated area 5 and, simultaneously therewith the leading portion 1*b* of the metallic member 1 on the other side of the heated area 5 adjacent the clamp 20 is axially inwardly pushed by the movement of the pusher 3A while the trailing portion 1*a* of the metallic member 1 on one side of the heated area 5 adjacent the tailstock 2 is fixed in position relative to the tailstock 2 to inwardly compress that portion of the metallic member 1 corresponding in position to the heated area 5 to accomplish the wall thickening. However, if desired, the wall thickening machine may be so designed that, while the leading portion 1*b* of the metallic member 1 is fixed in position, the heating unit 4 is moved axially of the metallic member 1 in a direction close towards the tailstock 2 and, simultaneously therewith, the trailing portion 1*a* of the metallic member 1 is axially inwardly moved. Also, an alternative is possible in that, while the heating unit 5 is held still at a fixed position, the trailing and leading portions 1*a* and 1*b* of the metallic member 1 are axially pushed in a direction close towards each other.

Figure 6:
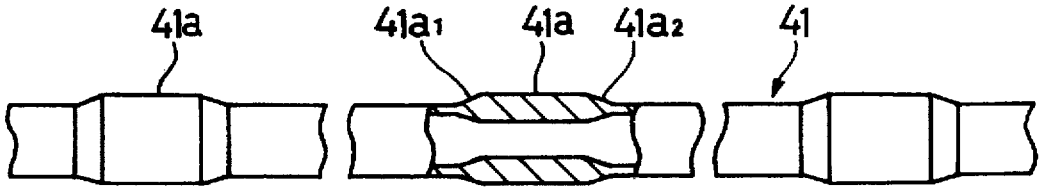
FIG. 6 is a longitudinal view, with a portion cut away, of the elongated metallic member manufactured by the apparatus shown in FIG. 4.

FIG. 6 illustrates an example of the metallic member 1 processed according to the wall thickening method of the present invention. The metallic member 1 shown therein is a square tubular member in which a plurality of, for example, three, axially spaced thickened wall areas 41*a* are successively formed by the wall-thickening method of the present invention. As shown therein, each of the thickened wall areas 41*a* of the metallic member 1 has gradient portions $41a_1$ and $41a_2$ on respective sides thereof having been inclined in opposite senses to each other, each of said gradient portions $41a_1$ and $41a_2$ having a gentle gradient. The center-to-center spacing between each neighboring thickened wall areas 41*a* of the metallic member 1 may be so chosen that, when the metallic member 1 is used as an architectural skeleton column that extends through a plurality of stories of a building, floor skeleton beams can be connected to the neighboring thickened wall areas 41*a*, respectively. In such case, the axial length of each thickened wall area 41*a* of the metallic member 1 may be so chosen as to correspond to the width of the associated floor skeleton beam. Thus, it will readily be seen that, because of the presence of the thickened wall areas 41*a* in the metallic member 1, the latter can advantageously be used as the architectural skeleton column for use in a multi-story building.

Figure 7A:
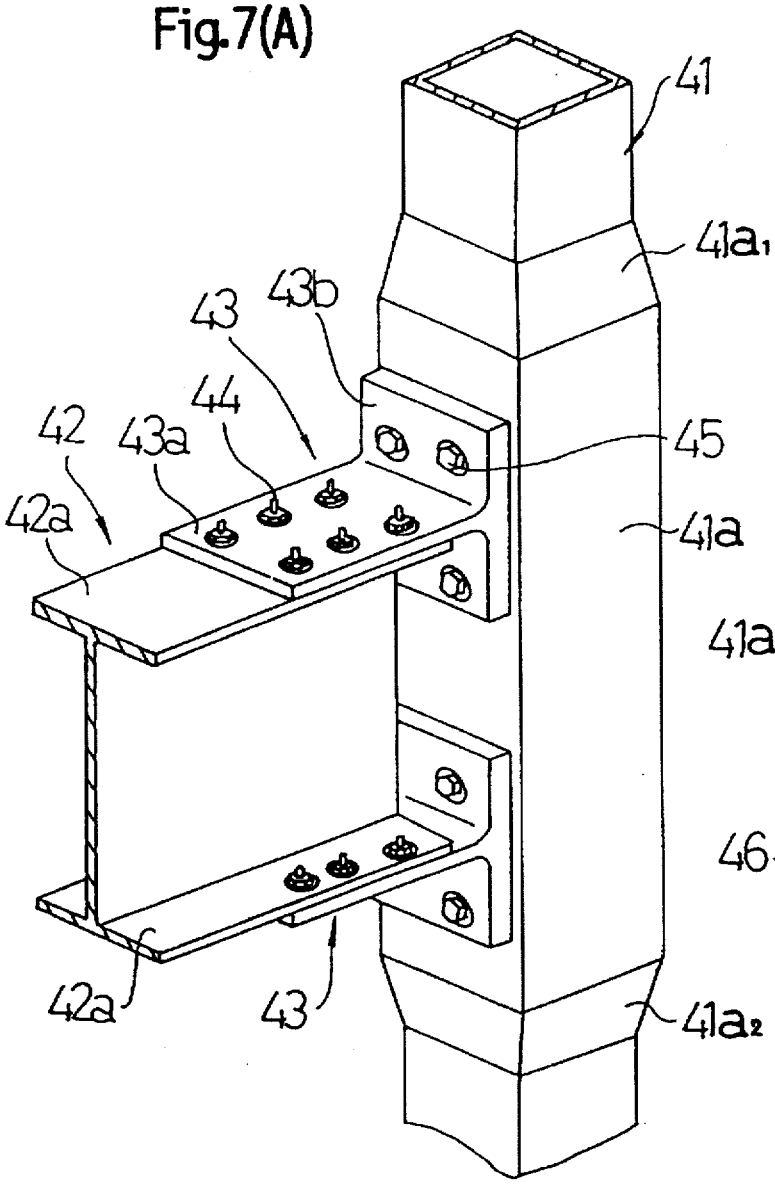
FIGS. 7(A) and 7(B) are perspective and longitudinal sectional views, respectively, showing a first embodiment of a first beam-to-column connecting method of the present invention in which the elongated metallic member manufactured by the use of the apparatus shown in FIG. 4 is employed.
Figure 7B:
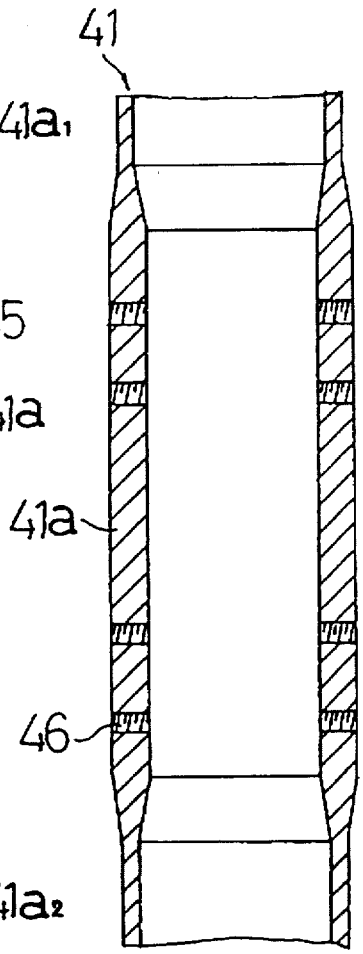

FIG. 7 illustrates a method of connecting a skeleton beam with an architectural skeleton column according to a first preferred embodiment of the present invention. That is to say, FIG. 7 illustrates an example of use of the metallic member 1 formed with the thickened wall areas 41*a* for connection with floor skeleton beams. The metallic member shown in FIG. 7 is identified as an architectural skeleton column 41 in the form of a square steel pipe formed with a plurality of thickened wall areas 41*a* (only one of which is shown therein) in the manner as hereinbefore described in accordance with the present invention. An steel skeleton beam 42 is bolted at one end to the thickened wall area 41*a* of the skeleton steel pipe column 41 through split tee members 43. The thickened wall area 41*a* in the steel pipe column 41 has a height greater than and sufficient to encompass a region where the split tee members 43 are bolted together with the steel skeleton beam 42 while the wall portion of that thickened wall area 41*a* bulged inwardly and outwardly.

The steel skeleton beam 42 so far shown is in the form of a H shape steel having upper and lower flanges 42*a*. Each of the split tee members 43 has a generally rectangular base 43*b* firmly connected to the thickened wall area 41*a* of the steel pipe column 41 by means of high strength bolts 45 threadingly tapped into corresponding internally threaded holes 46 defined in that thickened wall area 41*a* of the steel pipe column 41. Each split tee member 43 also has a cantilever arm 43*a* formed integrally with the rectangular base 43*b* so as to extend at right angles thereto, said cantilever arm 43*a* being firmly connected to the associated upper or lower flange 42*a* of the steel skeleton beam 42 by means of high strength bolt-and-nut elements 44. A portion of the thickened wall area 41*a* around each internally threaded hole 46 may be hardened by a heat treatment and, if this heat treatment is effected to harden that portion of the thickened wall area 41*a* around each internally threaded hole 46, the connecting strength can be increased.

According to the joint structure shown in FIG. 7, since the joint at which the steel pipe column 41 and the steel skeleton beam 42 are connected with each other is defined in the thickened wall area 41*a*, the steel pipe column 41 and the steel skeleton beam 42 are firmly bolted together by means of the split tee members 43 with no need to use any reinforcement member. For this reason, neither a backing plate nor any other reinforcement member need be employed and the consequence is that not only is construction simplified, but the required number of bolts and nuts may be reduced to thereby reduce the frequency of bolting procedures. This in turn brings about reduction in length of construction period. Moreover, the steel pipe column 41 may be used as a building column having no joint. Since the steel pipe column 41 is in the form of a steel pipe, the cost required to make it can be reduced advantageously as compared with the case in which a similar column is made by casting.

Furthermore, the gradient portions $41a_1$ and $41a_2$ on respective sides of each thickened wall area 41*a* are effective to avoid any possible localized stress set-up, thereby enhancing a reinforcement effectively in the presence of the thickened wall area 41*a*. If desired, concrete material may be filled into the hollow of the steel pipe column 41 for added reinforcement purpose.

Figure 8A:
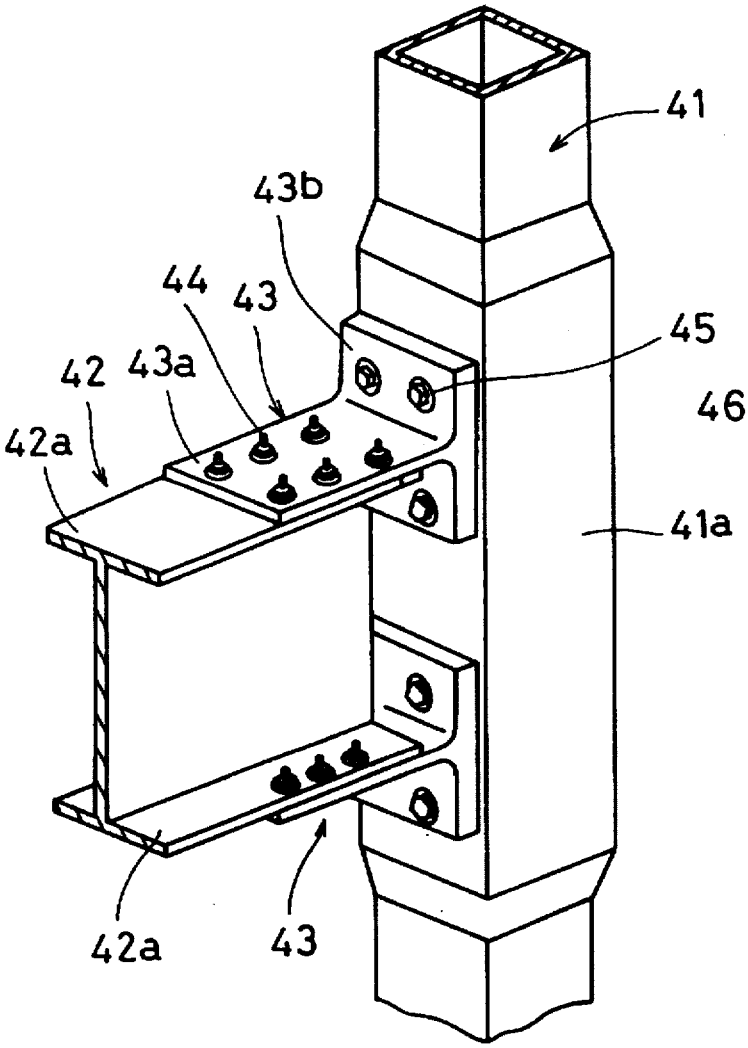
FIGS. 8(A) and 8(B) are perspective view and longitudinal sectional views, respectively, showing a second embodiment of the beam-to-column connecting method.
Figure 8B:
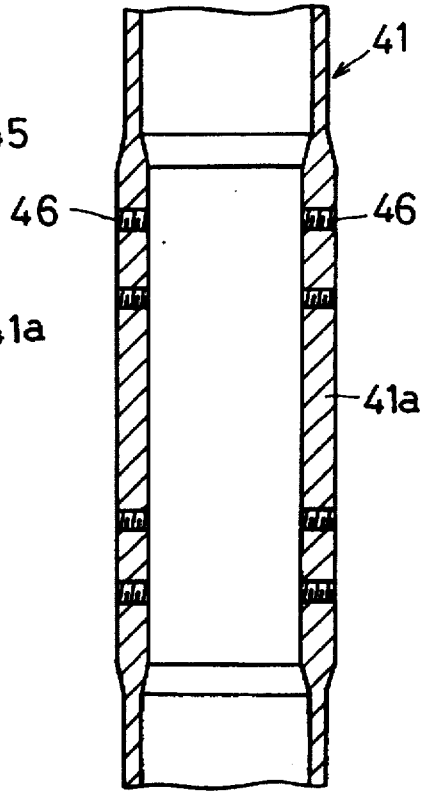
Figure 9A:
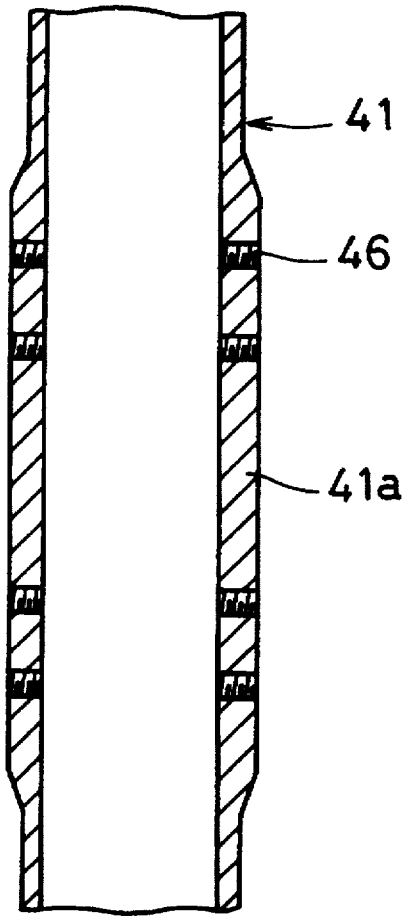
FIGS. 9(A) and 9(B) are longitudinal sectional views showing modified forms of the steel pipe column, respectively.
Figure 9B:
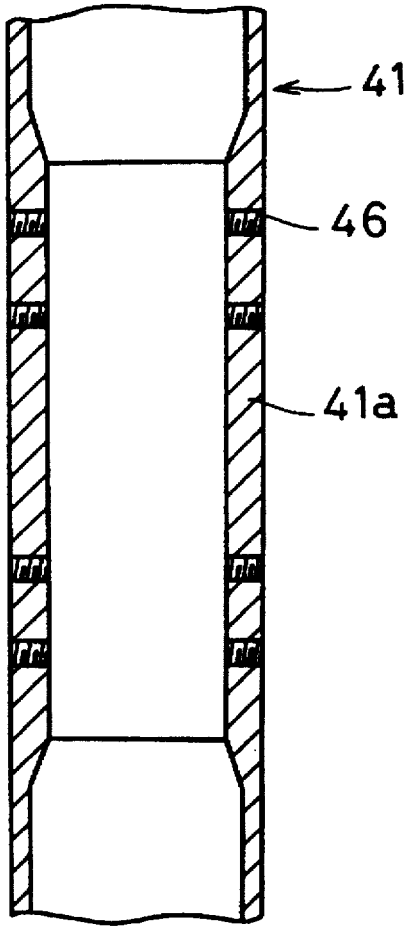

FIG. 8 illustrates a method of connecting a skeleton beam with an architectural skeleton column according to a second preferred embodiment of the present invention, in which the elongated metallic member having wall-thickened portions formed by the previously discussed wall thickening method is used as the architectural skeleton column. Although the metallic member 41 shown therein is also in the form of a steel pipe column formed with at least one thickened wall area 41*a*, the gradient of each of the gradient portions $41a_1$ and $41a_2$ on respective sides of the thickened wall area 41*a* is chosen to be steep. Except for the steep gradient chosen for each of the gradient portions $41a_1$ and $41a_2$ in the example of FIG. 8, the steel pipe column shown in FIG. 8 is substantially similar to that shown in and described with reference to FIG. 7. It is to be noted that the thickened wall area 41*a* may be of either a design in which only an outer surface of the thickened wall area 41*a* is outwardly bulged as shown in FIG. 9(A) or a design in which only an inner surface of the thickened wall area 41*a* is inwardly bulged as shown in FIG. 9(B). Even in the case of FIG. 8, concrete material may be filled in the hollow of the steel pipe column 41 for reinforcement purpose if so desired.

It is also to be noted that, even in the steel pipe column 41 shown in FIG. 7, the thickened wall area 41*a* may be of either a design in which only an outer surface of the thickened wall area 41*a* is similarly outwardly bulged or a design in which only an inner surface of the thickened wall area 41*a* is similarly inwardly bulged.

Figure 10A:
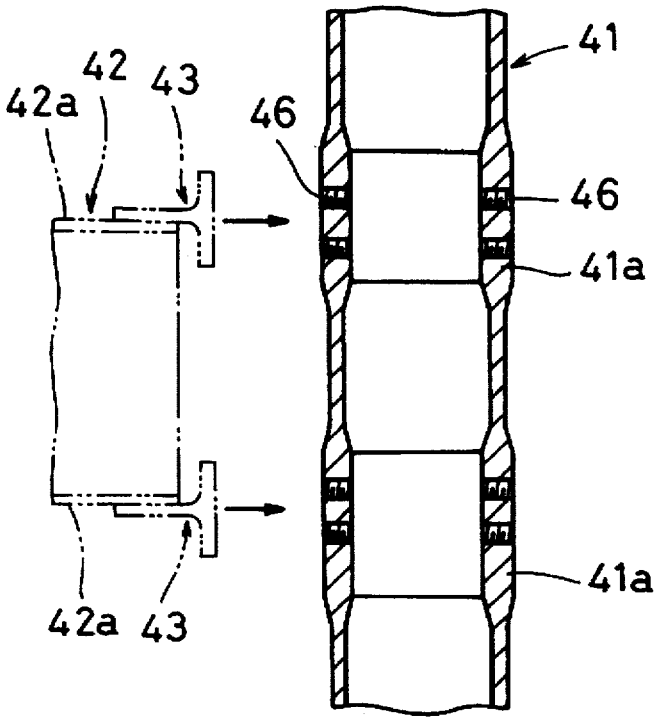
FIGS. 10(A) and 10(B) are longitudinal sectional views showing further modified forms of the steel pipe column, respectively.
Figure 10B:
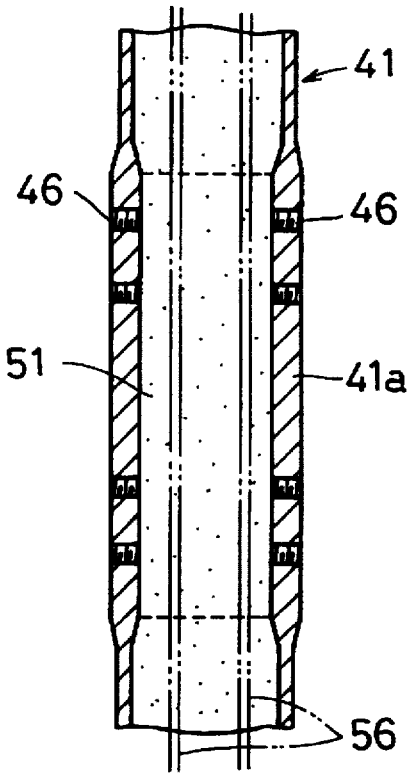

FIGS. 10(A) and 10(B) illustrate modified forms of the steel pipe column 41 employed in the previously discussed embodiment, respectively. Shown in FIG. 10(A) is the example in which two thickened wall area 41*a* in the steel pipe column 41 are utilized for bolted connection with steel skeleton beam 42 made of a shape steel such as an H shape steel through the single split tee members 43 and for this purpose the two thickened wall areas 41*a* are spaced a distance corresponding to the spacing between the upper and lower flange 42*a* of the steel skeleton beam 42. According to the connection shown in FIG. 10(A), since the upper and lower flanges 42*a* of the steel skeleton beam 42 to which a relatively large load is transmitted from the beam are bolted to and supported by the respective thickened wall areas 41*a*, a sufficient strength can be obtained even though the sum of the respective axial lengths of these two thickened wall areas 41*a* is reduced and, hence, the amount of steel used can advantageously be reduced.

FIG. 10(B) illustrates the example in which concrete material 51 is filled into the hollow of the steel pipe column 41 over the entire axial length thereof. The filling of the concrete material 51 increases not only an axial compressive strength of the steel pipe column 41, but also a resistance to a compressive load acting laterally from the steel skeleton beam 42 to the steel pipe column 41. If desired, one or more steel reinforcement bars as shown by the phantom lines 56 may be embedded in the concrete material 51 within the hollow of the steel pipe column 41. Also, the concrete material 51 may not be always filled in the hollow of the steel pipe column 41 over the entire axial length thereof, but may be filled only in respective portions of the hollow of the steel pipe column 41 corresponding in position to the thickened wall areas 41*a*. In this case, since projections resulting from the thickened wall areas 41*a* exit on the inner surface of the steel pipe column 41, the load is smoothly transmitted from the concrete material 51 to the steel pipe column 41 or from the steel pipe column 41 to the concrete material 51 and the structural characteristic is therefore increased.

Figure 11A:
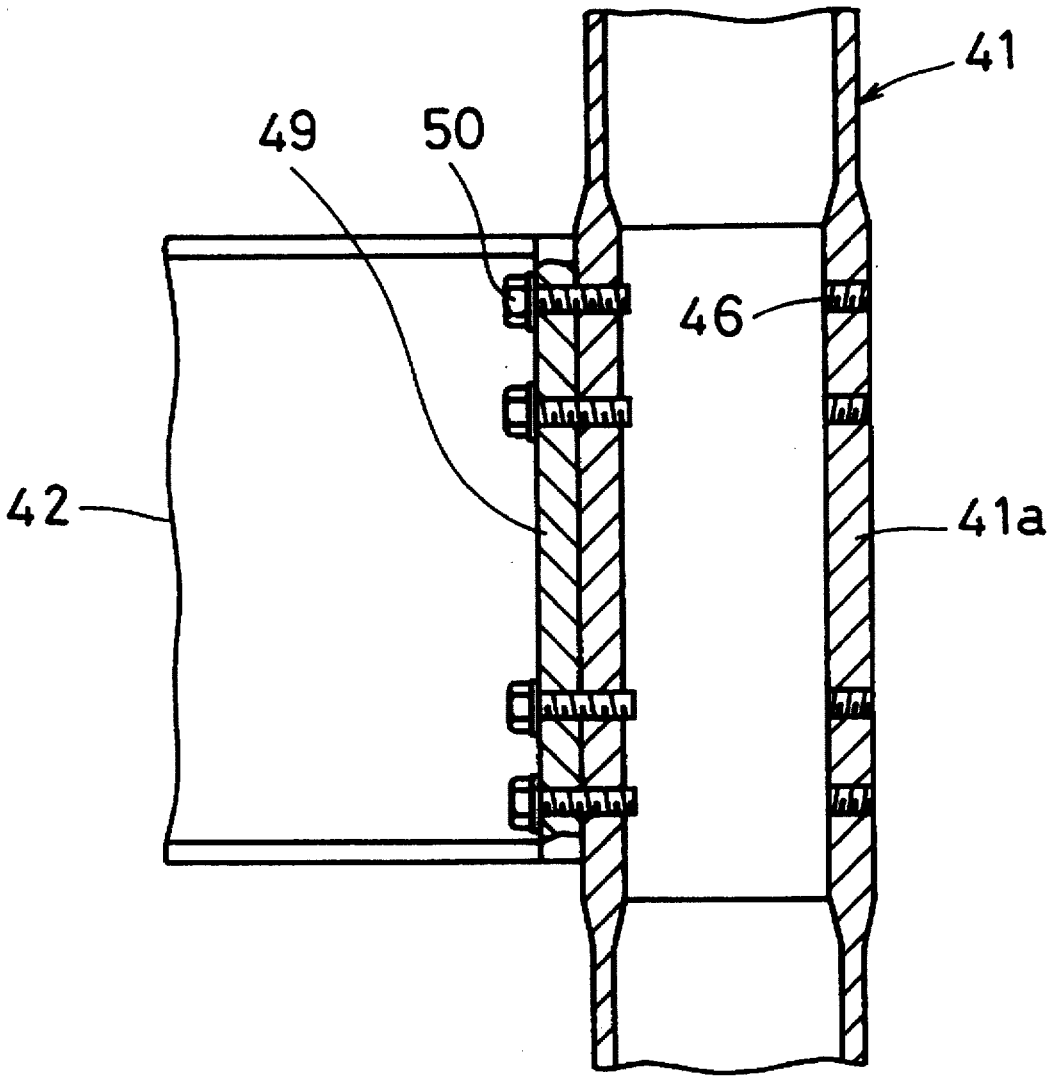
FIGS. 11(A) and 11(B) are longitudinal sectional views, showing third and fourth preferred embodiments of the beam-to-column connecting method of the present invention.
Figure 11B:
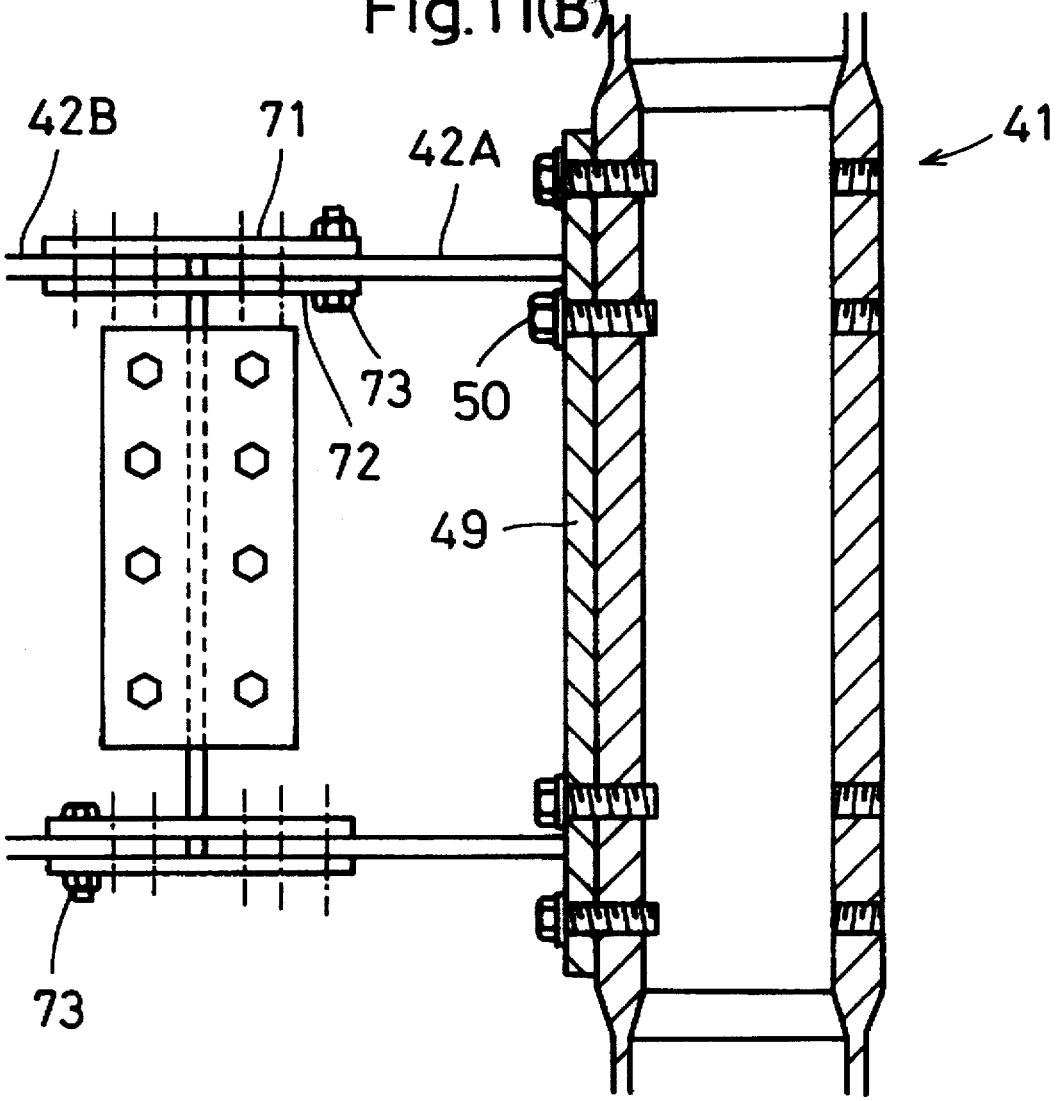

While in any one of the foregoing embodiments shown in FIGS. 7 to 9, respectively, the split tee members 43 have been shown and described as used, the use of the split tee members 43 may not be always essential. For example, according to a third preferred embodiment of the present invention shown in FIG. 11(A), an end plate 49 is welded to one end of the steel skeleton beam 42 and is in turn bolted to the thickened wall area 41*a* of the steel pipe column 41 by means of a plurality of bolts 50. On the other hand, according to a fourth preferred embodiment of the present invention shown in FIG. 11(B), one end portion 42A of the steel skeleton beam 42 is separated from an elongated body 42B, and the end plate 49 welded at one end to the end portion 42*a* is bolted at the opposite end to the thickened wall area 41*a* of the steel pipe column 41, said end portion 42A being in turn jointed to the elongated body 42B through upper and lower bridge plates 71 and 72 by the use of bolt-and-nut elements 73.

Although in any one of the foregoing preferred embodiments of the present invention shown respectively in FIGS. 7 to 11 the bolts 45 or 50 have been shown and described as firmly threaded into corresponding internally threaded holes 46 defined in the thickened wall area or areas 41*a* of the steel pipe column 41, the use of the internally threaded holes 46 may not be always essential and, instead, mere through-holes each being of a diameter sufficient to accommodate the corresponding bolt therethrough may be formed in the thickened wall area 41*a* provided that an attendant worker can make access to a free end of each bolt having passed through the through-holes, and hence situated within the hollow of the steel pipe column 41, for fastening a corresponding nut to such free end of the bolt. Where bolts and nuts are used in combination with the mere through-holes defined in the thickened wall area 41*a* of the steel pipe column 41, each bolt used to connect the steel skeleton beam 42 to the steel pipe column 41 either through the split tee members or through the end plate can be firmly threaded into the associated nut if, prior to the bolting being performed, such nut is bonded, or otherwise welded, to an inner surface of the steel pipe column 41 in alignment with the corresponding through-hole in the thickened wall area 41*a*.

Figure 12:
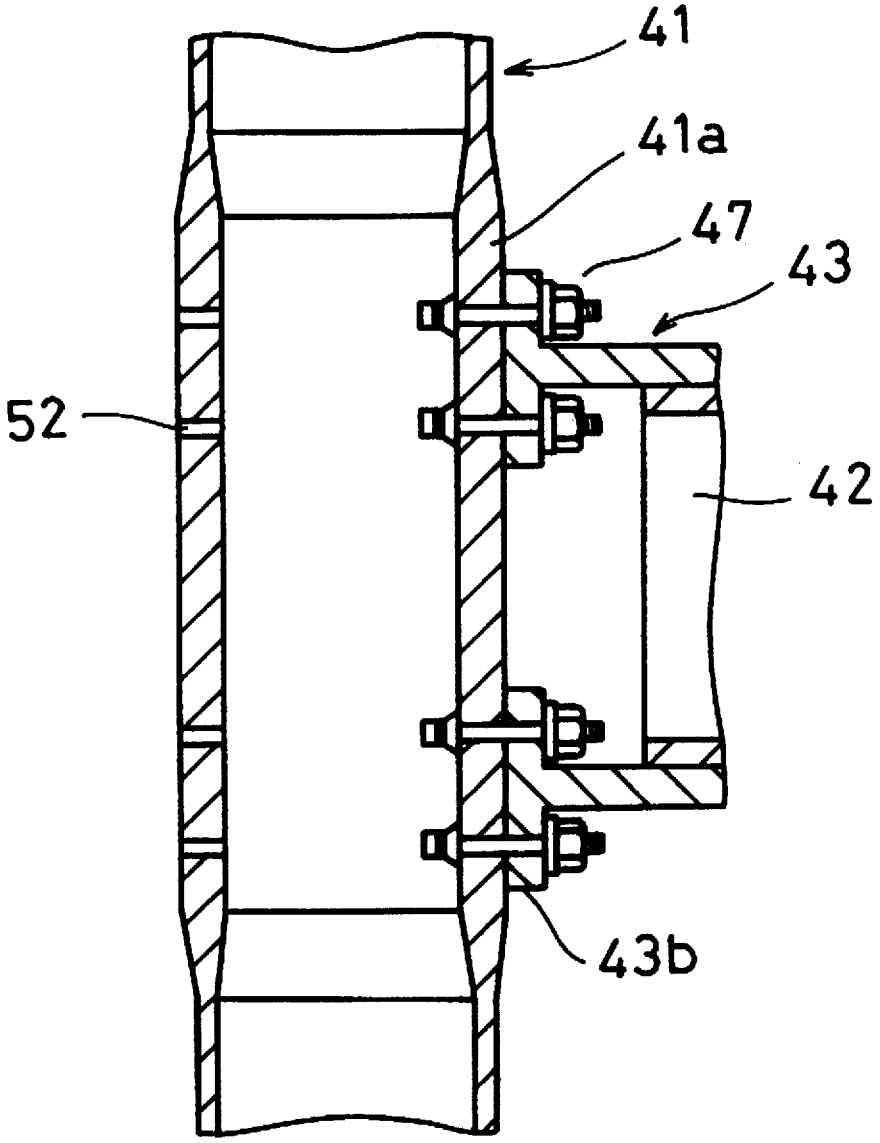
FIG. 12 is a longitudinal sectional view showing a fourth preferred embodiment of the beam-to-column connecting method of the present invention.

Also, instead of the use of the internally threaded holes 46, the use may be made of mere through-holes each being of a diameter sufficient to accommodate the corresponding bolt therethrough, in combination with one-side bolts 47 as shown in FIG. 12. The term "one-side bolt" referred to hereinabove and hereinafter means a generic term given to an axially threaded fastening element having a shank and a head formed at one end of the shank, which head expands radially outwardly by plastic deformation when the opposite end of the shank is pulled. This one-side bolt is often referred to as a blind bolt.

Figure 13A:
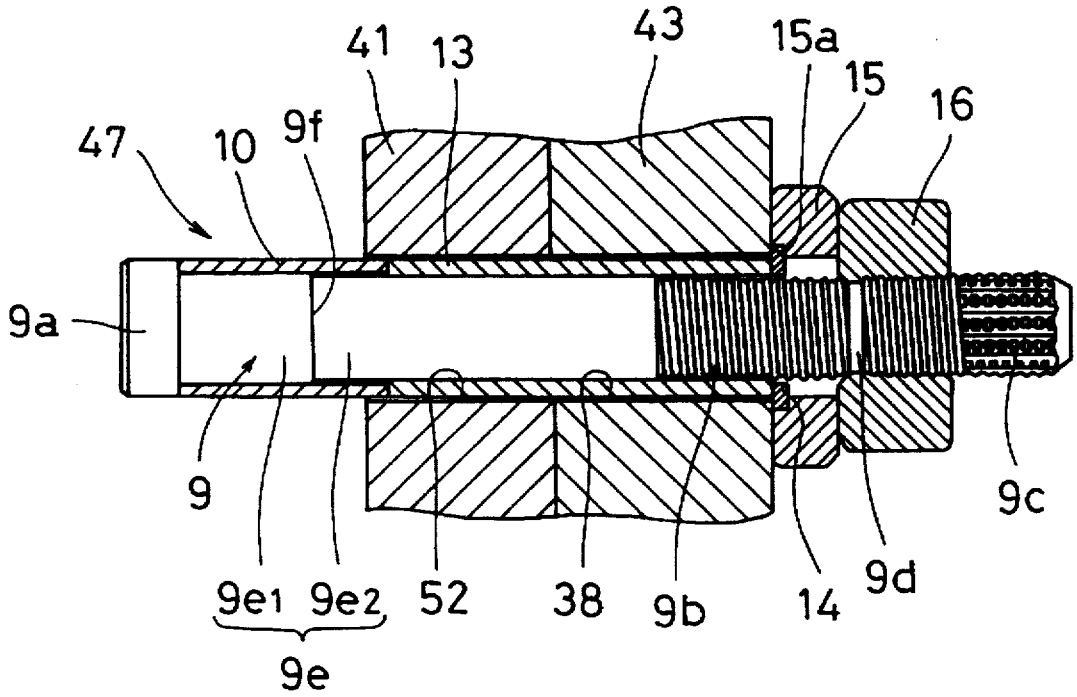
FIGS. 13(A) and 13(B) are longitudinal sectional views showing one-side bolt in different operative positions, respectively.
Figure 13B:
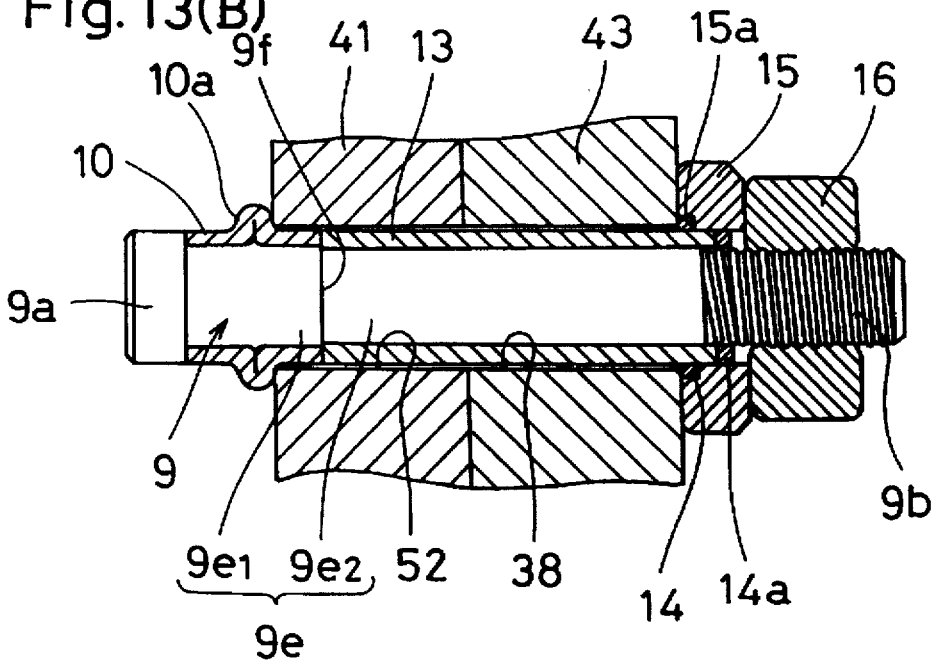

FIG. 13 illustrates one example of a one-side bolt 47 which may be used in the practice of the previously described method of connecting the steel skeleton beam 42 to the steel pipe column 41. The illustrated one-side bolt 47 includes a pin 9 having a pin head 9*a* at one end thereof, a valve sleeve 10 mounted on the pin 9 adjacent the pin head 9*a*, a grip sleeve 13 mounted on the pin 9 at one side of the valve sleeve 10 remote from the pin head 9*a*, a shear washer 14 mounted on the pin 9 at one side of the grip sleeve 13 opposite to the valve sleeve 10, a counter washer 15 mounted on the pin 9 at one side of the shear washer 14 opposite to the grip sleeve 13 and a nut 16 adapted to be threadingly mounted on an externally threaded portion 9*b* defined in the pin 9 on one side of a shank portion 9*e* opposite to the pin head 9*a*. The externally threaded portion 9*b* of the pin 9 has a generally intermediate portion formed with an annular break groove 9*d* at which the external thread is discontinued, and is provided with a pin tail 9*c* extending axially outwardly from the externally threaded portion 9*b* and having an outer surface formed with slip-preventive surface indentations which may be a plurality of axially extending rows of circumferentially spaced teeth. The pin head 9*a* has a diameter slightly greater than the shank portion 9*e*.

The valve sleeve 10 is made of material softer than the grip sleeve 13 and is capable of undergoing a plastic deformation to form a radially outwardly protruding collar 10*a* when an axial compressive force is applied thereto. By way of example, the grip sleeve 13 may be made of a hard steel alloy while the valve sleeve 10 may be made of a soft steel alloy. The counter washer 15 has a bore of a diameter sufficient to allow the grip sleeve 13 to pass therethrough and is formed with an annular recess 15*a* defined on one surface thereof confronting the pin head 9*a* so as to encompass the bore in the counter washer 15 for receiving therein an outer peripheral portion of the shear washer 14. The shear washer 14 has an inner peripheral portion engageable with an annular end face of the grip sleeve 13 and capable of being sheared when an axially acting force of a predetermined magnitude acts thereto.

So far as shown in FIG. 13, the shank portion 9*e* has a large diameter portion $9e_1$ and a reduced diameter portion $9e_2$ on respective sides of a circumferential step 9*f*, said large diameter portion $9e_1$ having a diameter slightly greater than that of the reduced diameter portion $9e_2$ and defined adjacent the pin head 9*a*. The grip sleeve 13 has a bore of a diameter smaller than the diameter of the large diameter portion 9*e*. It is to be noted that, alternatively, the shank portion 9*e* may have a uniform diameter over the length thereof.

Fastening of this one-side bolt 47 may be carried out by a motor-driven rotary fastening tool (not shown). Specifically, while the pin tail 9*c* is retained by the fastening tool, a nut 16 is fastened to the externally threaded portion 9*b* of the one-side bolt 47 by means of a box-like nut engagement of the fastening tool. As the nut 16 is fastened, a compressive force acts between the pin head 9*a* and the shear washer 14 to clamp the grip sleeve 13 and the valve sleeve 10 together in a direction axially inwardly of the one-side bolt 47, causing the valve sleeve 10 to undergo a plastic deformation so as to protrude radially outwardly, that is, to initiate a valving of the valve sleeve 10, thereby forming the radially outwardly protruding collar 10*a*. Where the shank portion 9*e* of the pin 9 has the circumferential step 9*f* as shown, the valving takes place up until the grip sleeve 13 is brought into abutment with the circumferential step 9*f*. As the nut 16 is further fastened, the shear washer 14 is sheared to allow the grip sleeve 13 to protrude into the shear washer 14 while allowing the radially outwardly protruding collar 10*a* of the valve sleeve 10 to be drawn close towards an inner surface of the steel pipe column 41. When the radially outwardly protruding collar 10*a* of the sleeve 10 is subsequently brought into engagement with the inner surface of the steel pipe column 41, an axially acting fastening force required to connect the wall of the steel pipe column 41 and the split tee member 43 together firmly is created between the nut 16 and the radially outwardly protruding collar 10*a*. Continued fastening of the nut 16 results in breakage of the pin tail 9*c* at the annular break groove 9*d*. (See FIG. 13(B)).

Where this one-side bolt 47 is employed, the following firm connection is possible. Specifically, because of the shear breakage of the shear washer 14, the fastening force developed between the nut 16 and the radially outwardly protruding collar 10*a* is directly utilized as a clamping force required to clamp the wall of the steel pipe column 41 and the split tee member 43 together, thereby accomplishing a firm connection therebetween. The use of the one-side bolt 47 brings about the following advantages.

In the first place, since the radially outwardly protruding collar 10*a* of the valve sleeve 10 which forms a substantial head of the bolt considerably expands radially outwardly, the pressure of contact with the wall of the steel pipe column 41 decreases and, also, a relatively large tolerance is available in choosing the diameter of the bolt hole. By way of example, there is no possibility that, consequent upon deformation of a peripheral lip region of the bolt hole under the influence of the contact pressure, the head of the bolt may be plugged into the bolt hole. Therefore, the head of the bolt defined by the radially outwardly protruding collar 10*a* gives rise to an increased resistance to load and, at the same time, the one-side bolt 47 develops an increased fastening force with the efficiency.

Also, since the fastening is accomplished by turning the nut 16, double fastening or re-fastening is possible. Moreover, since an electric tool is used for fastening, on-site handling is easy to accomplish.

In the case of a one-side bolt 47A of a type capable of being fastened by a pulling action as will be described later with reference to FIG. 14, a hydraulic fastening tool of, for example, 20 Kg in weight is required to obtain an axial compressive force necessary to accomplish a rigid connection in a building, but the intended fastening is sufficiently and effectively accomplished with the electric rotary tool of about 10 Kg. The use of the light-weight electric rotary tool dispenses with the use of a heavy piping, but with a light-weight electric cable, and therefore, the workability is considerably increased. Also, no priming of the hydraulic unit is needed and the fastening job at a high story can be performed easily. The pin tail 9*c* that is disposed of after the fastening of the nut 16 to the bolt has a relatively small length and, therefore, waste of a limited material resource is minimized. Moreover, since the number of component parts of the one-side bolt is small, the cost can be reduced.

Figure 15:
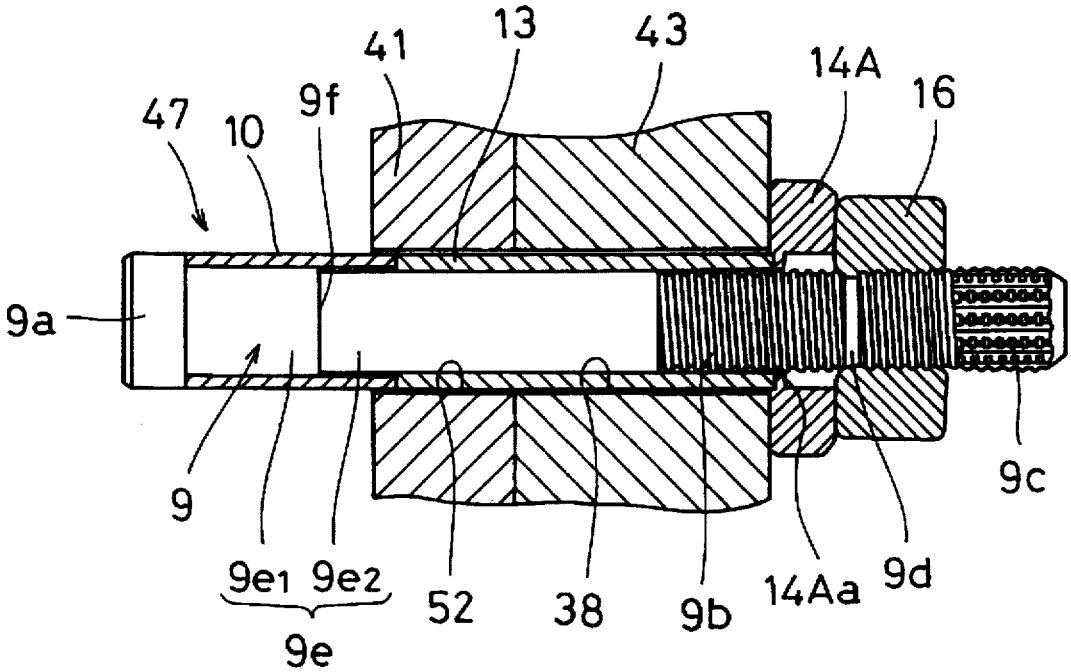
FIG. 15 is a longitudinal sectional view showing a variation of the one-side bolt shown in FIGS. 13(A) and 13(B)

It is to be noted that, in place of the shear washer 14 and the counter washer 15, an internally flanged shear washer 14A which possibly corresponds to an integrated version of the shear washer 14 and the counter washer 15 may be employed as shown in FIG. 15. The internally flanged shear washer 15 shown in FIG. 15 has a bore of a diameter sufficient to allow the grip sleeve 13 to pass therethrough and has an inner peripheral surface formed with a radially inwardly protruding flange 14A*a* which is adapted to be sheared by the effect of a predetermined axially acting force upon engagement with an end face of the grip sleeve 13. Even this one-side bolt 47 of a type having the internally flanged shear washer 14A can be fastened in a manner similar to the one-side bolt 45 of a type having the separate shear and counter washers 14 and 15.

FIG. 14 illustrates a different one-side bolt 47A. The illustrated one-side bolt 47A includes a pin 31 having a pin head 31*a* at one end thereof, a first sleeve 32 mounted on the pin 31 adjacent the pin head 31*a*, a second sleeve 33 mounted on the pin 31 at one side of the first sleeve 32 remote from the pin head 31*a*, a tubular grip adjustment 34 mounted on the pin 31 at one side of the grip sleeve 33 opposite to the first sleeve 32, a washer 35 mounted on the pin 31 at one side of the grip adjustment 34 opposite to the grip sleeve 33 and a collar 36. The head 31*a* of the pin 31 is of a diameter somewhat greater than the pin 31, and a generally intermediate portion of the pin 31 has a toothed outer peripheral surface 31*c* similar to a screw groove and an annular break groove 31*b*. The opposite end portion of the pin 31 remote from the head 31*a* is formed into a pin tail 31*d* having its outer peripheral surface formed with surface indentations and adapted to be gripped by a chuck 37*b* of a fastening tool 37 as will be described later. The surface indentations may be a plurality of axially spaced annular grooves.

The second sleeve 33 has one end adjacent the first sleeve 32 tapered axially outwardly so that the axially outwardly tapered end of the second sleeve 33 can be plugged into and subsequently enlarge the adjacent end of the first sleeve 32 radially outwardly. The tubular grip adjustment 34 is made up of a large diameter tube 34*a* and a reduced diameter tube 34*b* continued from the large diameter tube 34*a* through a circumferential step 34*c*, said reduced diameter tube 34*b* being capable of telescopically received within the large diameter tube 34*a* when the circumferential step 34*c* is broken under the influence of a predetermined axial load. The collar 36 is in the form of a tube of a short length and has one end adjacent the pin tail 31*d* flared radially outwardly to define a flared tube 36*b*, said flared tube 36*b* of the collar 36 being adapted to undergoes a plastic deformation, when radially inwardly drawn, to allow the inner peripheral surface of said flared tube 36*b* to bite the toothed outer peripheral surface 31*c* of the pin 31.

Figure 14A:
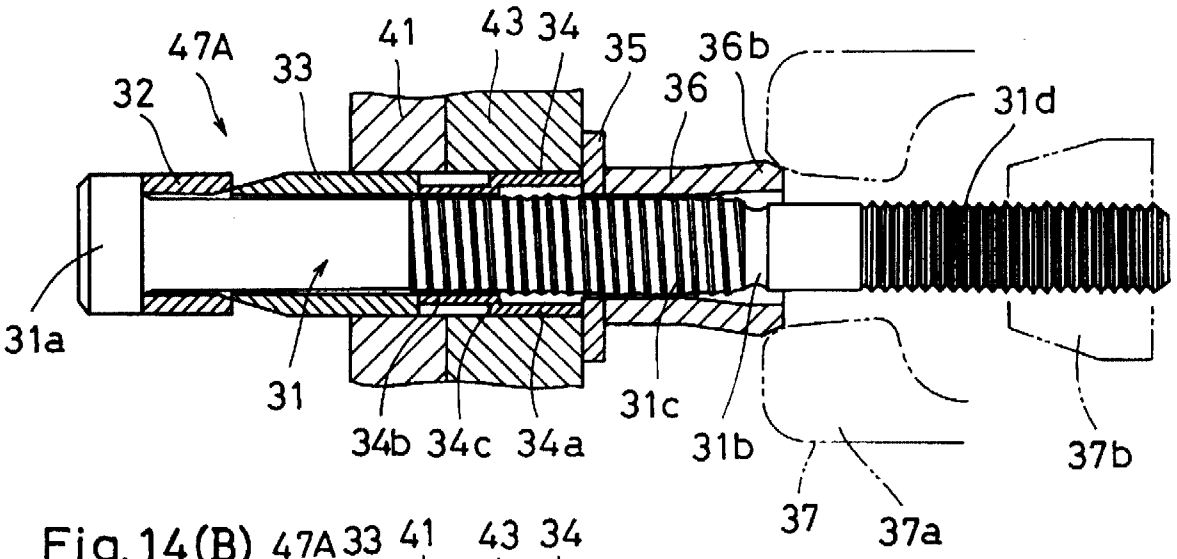
FIGS. 14(A) and 14(B) are longitudinal sectional views showing a different form of one-side bolt in different operative positions, respectively.
Figure 14B:
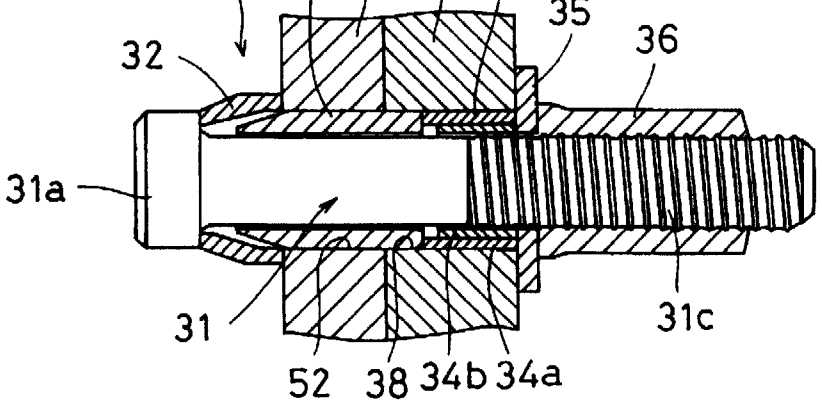

Fastening of this one-side bolt 47A is carried out by the use of the fastening tool 37 as shown in FIG. 14(A). The fastening tool 37 is of a type including a tubular chucking guide 37*a* engageable with an annular end of the collar 36 in the one-side bolt 47A and a chuck 37*b* adapted to grip the pin tail 31*d* and has an actuator (not shown) built therein for drawing the chuck 37*b* axially relative to the chucking guide 37*a*. When the pin tail 31*d* is pulled axially outwardly by the chuck 37*b* while the chucking guide 37*a* is held in abutment with the collar 36, a compressive force necessary to clamp the washer 35, the annular grip adjustment 34, the second sleeve 33 and the first sleeve 32 in a direction close towards each other acts between the collar 36 and the head 31*a* of the pin 31. By this compressive force, the tapered end of the second sleeve 33 is first plugged into the first sleeve 32 to enlarge the first sleeve 32 radially outwardly. After completion of radial outward deformation of the first sleeve 32, the annular grip adjustment 34 breaks at the circumferential step 34*c* to allow the reduced diameter tube 34*b* to be inserted into the large diameter tube 34*a* with the first sleeve 32 consequently brought into engagement with the steel pipe column 41. Thereafter, radial inward drawing of the collar 36 by the chucking guide 37*a* of the fastening tool 37 starts to introduce an axially acting force to the wall of the steel pipe column 41 and the split tee member 43 to thereby connect the steel pipe column 41 and the split tee member 43 firmly together. As the chuck 37*b* is subsequently pulled outwardly, radial inward drawing of the collar 36 completes with the inner peripheral surface of the collar 36 consequently biting the toothed outer peripheral surface 31*c* of the pin 31 to fix the collar 36 relative to the pin 31 while the predetermined axial force is introduced to break the pin tail 31*d* at the break groove 31*b*. See FIG. 14(B). In this way, the steel pipe column 41 and the split tee member 43 are clamped firmly together between the first sleeve 32, then enlarged radially outwardly, and the collar 36.

Even the use of the one-side volt 47A in the manner described above is effective to accomplish the firm connection between the steel pipe column 41 and the split tee member 43. Specifically, in this one-side bolt 47A, a fastening force developed between the first sleeve 32 and the collar 36 when the grip adjustment 34 is sheared provides a clamping force necessary to clamp the steel pipe column 41 and the split tee member 43 firmly together and, therefore, the firm fastening is possible.

Figure 16A:
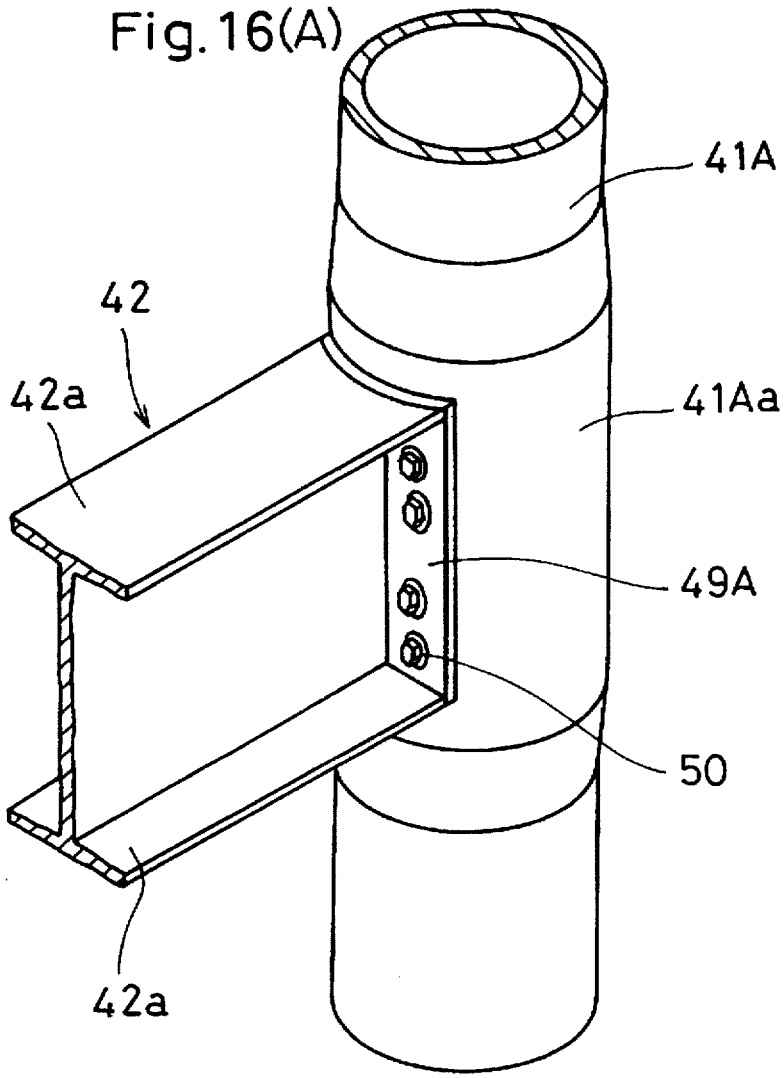
FIG. 16(A) is a perspective view showing a fifth preferred embodiment of the beam-to-column connecting method of the present invention.

FIG. 16(A) illustrates a fifth preferred embodiment of the first method of connecting a skeleton beam with an architectural skeleton column according to the present invention. In this preferred embodiment of the present invention, a round steel pipe having at least one thickened wall area formed therein by the previously discussed wall thickening method is used as a skeleton column 41A. As shown therein, this round steel pipe column 41A has at least axial portion formed with the thickened wall area 41A*a*. The steel skeleton beam 42 is of a type having an end plate 49A welded thereto and having a curvature corresponding to an outer peripheral surface of the thickened wall area 41A*a*, and is bolted firmly to the thickened wall area 41A*a* by tapping a plurality of bolts 50, passing through bolt holes in the end plate 49A, into corresponding internally threaded holes defined in the thickened wall area 41A*a* of the steel pipe column 41A. As is the case with the thickened wall in the previously discussed square steel column 41, the thickened wall area 41A*a* may be of a type protruding radially outwardly and/or inwardly. Also, the thickened wall area 41A*a* may be formed at a plurality of axial portions of the steel pipe column 41A in a manner similar to those shown in FIG. 10(A). Even in this embodiment, if desired, concrete material may be filled in the hollow of the steel pipe column 41A.

Figure 16B:
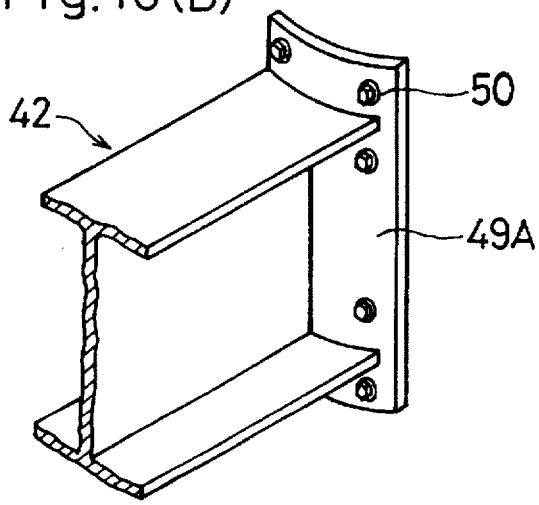
FIG. 16(B) is a diagram showing a modification of the fifth preferred embodiment of the present invention.

FIG. 16(B) illustrates a modification of FIG. 16(A). According to this modification, the end plate 49A is formed to have a length greater than that of the beam 42 and is connected to the skeleton column 41A by means of the bolts at respective locations outwardly of upper and lower portion of the beam 42. It is to be noted that, in the example shown in any one of FIGS. 16(A) and 16(B), the skeleton beam 42 requires the use of an intermediate rigid frame joint to accommodate a tolerance in beam manufacturing.

Figure 17A:
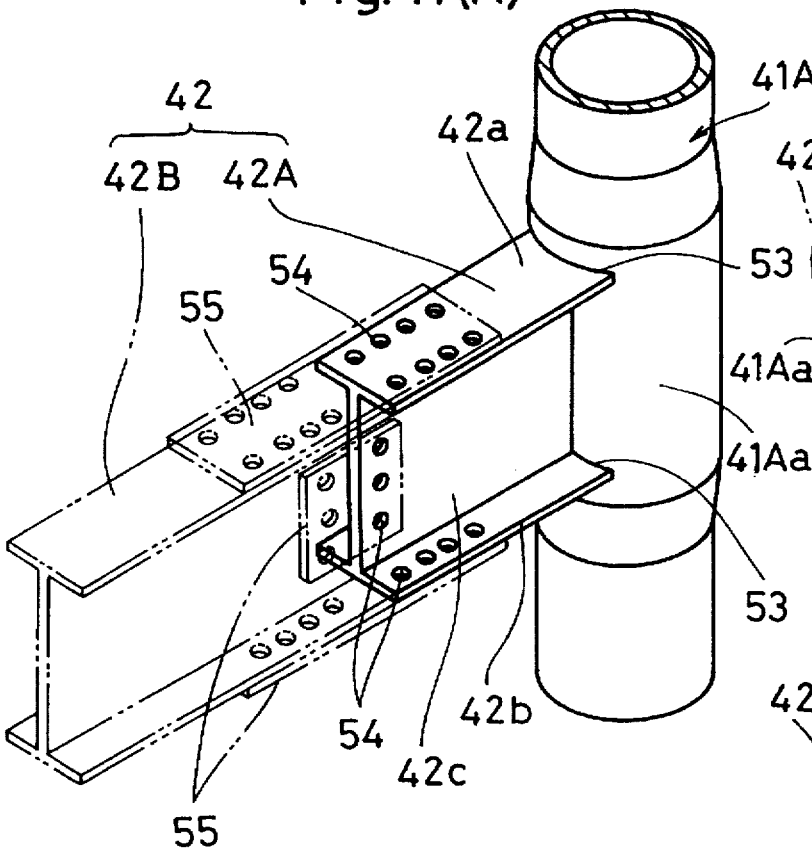
FIGS. 17(A) and 17(B) are perspective and longitudinal sectional views, respectively, showing one embodiment of a second beam-to-column connecting method of the present invention.
Figure 17B:
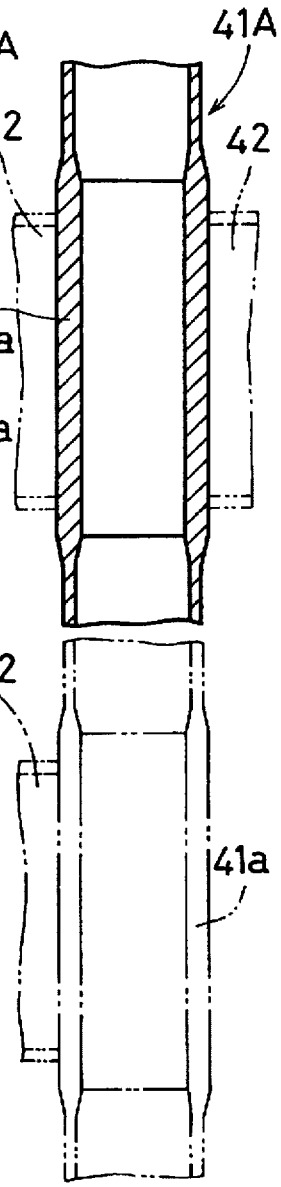

FIG. 17 illustrates one preferred embodiment of the second method of connecting a skeleton beam with an architectural skeleton column according to the present invention. In this preferred embodiment of the present invention, a round steel pipe having thickened wall areas 41A*a* formed therein over the circumference by the previously discussed wall thickening method shown in and described with reference to FIGS. 1 to 6 is used as a skeleton column 41A, and a bracket-like portion 42A which forms a joint with the steel skeleton beam 42 is welded. The steel pipe column 41A shown therein may be used as a column of a length corresponding to a plurality of building stories and have the plural thickened wall areas 41A*a* spaced a distance corresponding to the neighboring stories of a building for receiving the corresponding steel skeleton beams 42 that are welded thereto. It is to be noted that a plurality of steel skeleton beams 42 may be welded to one and the same thickened wall area 41A*a* so as to extend radially outwardly from the steel pipe column 41A.

Each thickened wall area 41A*a* has an axial length sufficient to extend a certain distance upwardly and downwardly from the depth of the steel skeleton beam 42 and protrudes radially inwardly and outwardly with respect to the remaining portion of the steel pipe column 41A. Alternatively, each thickened wall area 41A*a* may protrude only radially inwardly or radially outwardly.

The steel skeleton beam 42 shown in FIG. 17 comprises the bracket-like portion 42A and a beam body 42B both of which are employed in the form of an H shape steel. Welding of the bracket-like portion 42A to the steel pipe column 41A is carried out by shaping respective ends of upper and lower flanges 42*a* and 42*b* to have arcuate cutouts 53 each being of a curvature following the curvature of the thickened wall area 41A*a* and then by welding portions of the upper and lower flanges 42*a* and 42*b* defining the associated cutouts 53 and a web 42*c* to the thickened wall area 41A*a*. The upper and lower flanges 42*a* and 42*b* of the bracket-like portion 42A and the web 42*c* are formed with joint holes 54, and the beam body 42B held in abutment with the bracket-like portion 42A are bolted or rivetted by means of bridge plates 55 attached to the flanges 42*a* and 42*b* and the web 42*c*. Welding of the bracket-like portion 42A to the steel pipe column 41A may be carried out at a shop and the steel pipe column 41A welded with the bracket-like portion 42A may be transported to the site of construction so that, after erection of the steel pipe column 41A, the beam body 42B is jointed to the bracket-like portion 42A.

With this construction, since the portion of the steel pipe column 41A to which the steel skeleton beam 42 is jointed is constituted by the thickened wall area 41A*a*, the steel pipe column 41A and the steel skeleton beam 42 can be firmly connected together with no need to use any reinforcement member. For this reason, no job of fitting reinforcement members is necessary and a job of connecting the steel pipe column 41A and the steel skeleton beam 42 can be simplified. Moreover, the steel pipe column 41A can be used as a jointless column that extends a distance corresponding to a plurality of stories of a building and, since it is made of steel, the cost can be reduced as compared with that made by casting. In the practice of the embodiment of the present invention shown in FIG. 17, concrete material may be filled in the hollow of the steel pipe column 41A if so desired.

Figure 18A:
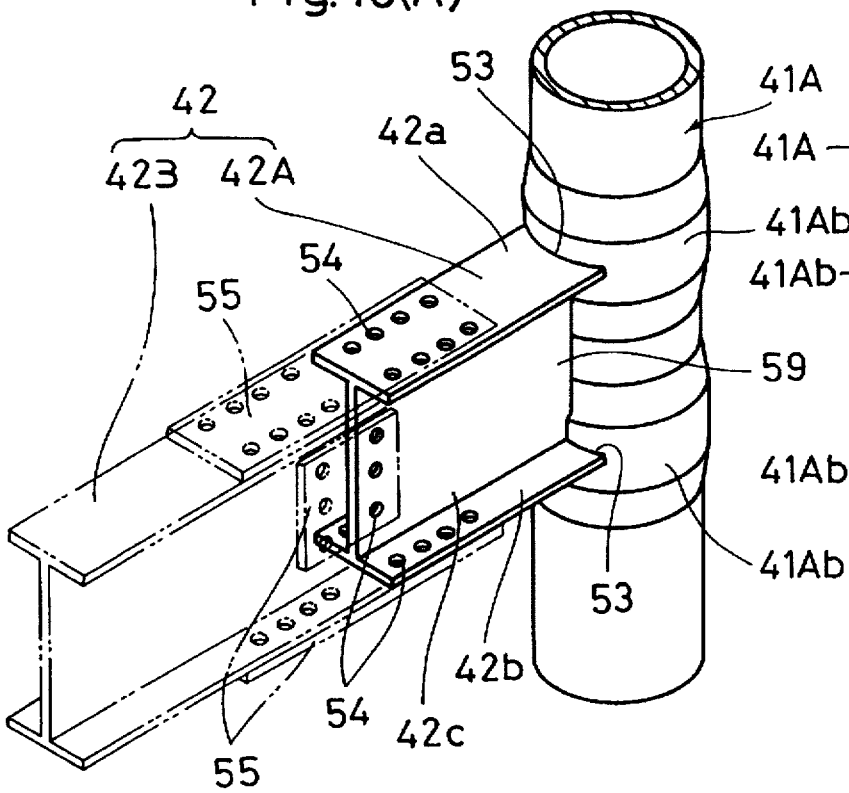
FIGS. 18(A) and 18(B) are perspective and longitudinal sectional views, respectively, showing a second preferred embodiment of the second beam-to-column connecting method of the present invention.
Figure 18B:
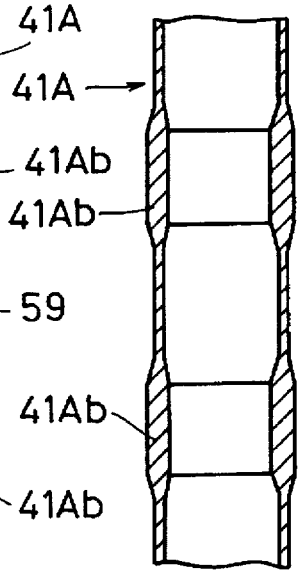

Referring now to FIG. 18, there is shown a second preferred embodiment of the second method of connecting a skeleton beam with an architectural skeleton column according to the present invention. In this preferred embodiment of the present invention, two thickened wall areas 41A*b* are employed in the round steel pipe column 41A for each steel skeleton beam 42. These two thickened wall areas 41A*b* are spaced a distance corresponding to the span between the upper and lower flanges 42*a* and 42*b* of the steel skeleton beam 42. As shown therein, one end of the web 42*c* of the bracket-like portion 42A of the steel skeleton beam 42 adjacent the steel pipe column 41A is cut out to provide a protuberance 59 adapted to contact an outer peripheral surface of a portion of the steel pipe column 41A between the thickened wall areas 41A*b*, and the entire end face of the web 42*c* and the respective ends of the upper and lower flanges 42*a* and 42*b* where the associated cutouts 53 are defined are welded to the steel pipe column 41A. Although each of the thickened wall areas 41A*b* of the steel pipe column 41A is shown as protruding radially inwardly and outwardly of the steel pipe column 41A as is the case with the thickened wall area 41A*a* shown in FIG. 14, it may protrude only radially inwardly or radially outwardly of the steel pipe column 41A.

Even in the embodiment shown in FIG. 18, as is the case with that shown in FIG. 10(B), concrete material 51 is filled in the hollow of the steel pipe column 41A. Thus, the concrete material may be filled in the hollow of the steel pipe column 41A, or one or more steel bars 56 may be embedded in the concrete material filled in the hollow of the steel pipe column 41A. Also, the concrete material may be filled only in regions of the hollow of the steel pipe column 41A where the thickened wall area 41A*b* are defined.

Even in this case, since projections resulting from the thickened wall areas 41A*b* exit on the inner surface of the steel pipe column 41A, the load is smoothly transmitted from the concrete material 51 to the steel pipe column 41A or from the steel pipe column 41A to the concrete material 51 and the structural characteristic is therefore increased.

Figure 19A:
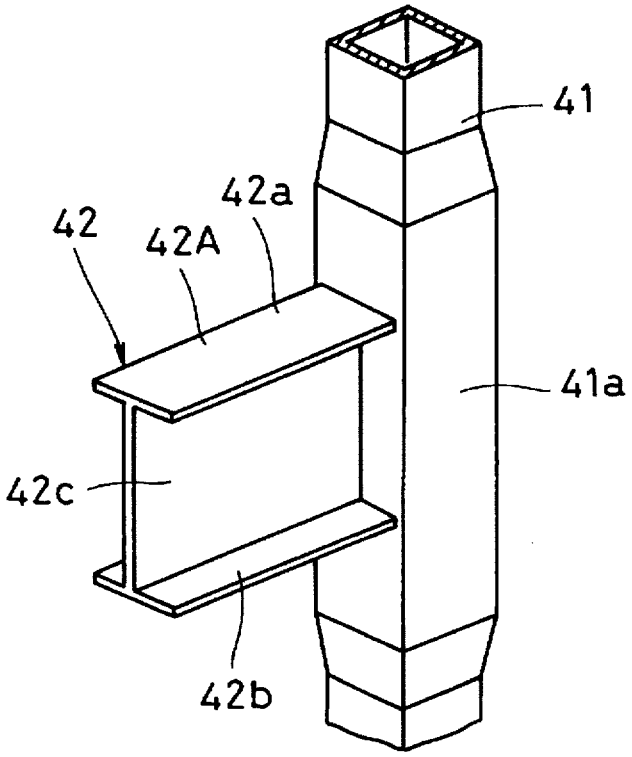
FIGS. 19(A) and 19(B) are perspective and longitudinal sectional views, respectively, showing a third preferred embodiment of the second beam-to-column connecting method of the present invention.
Figure 19B:
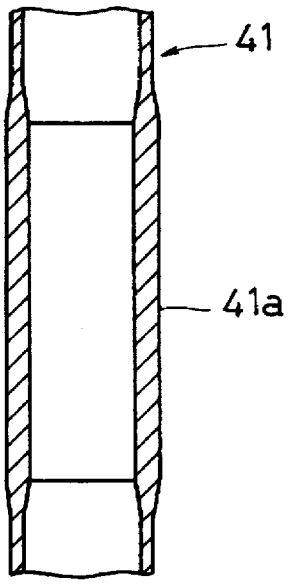

FIG. 19 illustrates a third preferred embodiment of the second method of connecting the steel pipe column with the steel skeleton beam. In this embodiment, the elongated metallic member 41 obtained by subjecting a square steel pipe to the wall thickening process is used as a steel pipe column and is, as is the case with the embodiment shown in and described with reference to FIG. 17, provided with at least one thickened wall area 41*a* having a uniform wall thickness over the circumference thereof. An end face of the bracket-like portion 42A of the steel skeleton beam 42 is welded to the thickened wall area 41*a* of the steel pipe column 41. In this embodiment, the end face of the web 42*c* which contacts the thickened wall area 41*a*. is formed with no cutout and remains flat: Although the thickened wall area 41*a* is shown as protruding outwardly and inwardly of the wall of the steel pipe column 41, it may protrude only inwardly or outwardly. Also, the steel pipe column 41 may have a plurality of thickened wall areas 41*a* corresponding in number to the number of stories of a building and/or the steel pipe column 41 may have two thickened wall areas 41*a* for each steel skeleton beam 42 as is the case with that shown in FIG. 18. It is also to be noted that concrete material may be filled in the hollow of the steel pipe column 41.

Even with this construction, as is the case with the round steel pipe column 41A, various advantages can be obtained in that the steel pipe column 41 and the steel skeleton beam 42 can be firmly connected with no need to use any reinforcement member.

It is to be noted that although in any one of the foregoing embodiments shown in FIGS. 17 to 19, the bracket-like portion 42A of the steel skeleton beam 42 has been shown and described as welded to the steel pipe column 41 or 41A, the steel skeleton beam 42 itself as a single member may be welded directly to the thickened wall area 41*a* or 41A*a* of the steel pipe column 41 or 41A. Again, in place of the H shape steel beam, any other elongated steel member of any desired sectional shape may be employed for the steel skeleton beam 42.

A first preferred embodiment of a first method of connecting steel pipes each obtained by the wall thickening process of the present invention will now be described with reference to FIG. 20. In this embodiment, two square steel pipes generally identified by 41 are substantially butt-jointed with each other as shown in FIG. 20(B). Each of these square steel pipes 41 has one end having its wall bulged to provide a thickened wall area 41*a* and, while the square steel pipes 41 are butt-jointed with each other, connecting members 57 are bolted to the respective thickened wall areas 41*a* of those steel pipes 41 by the use of one-side bolts 47 so as to straddle therebetween, thereby accomplishing a firm end-to-end connection of the steel pipes 41. So far as shown, the thickened wall area 41*a* of each of the steel pipes 41 is bulged outwardly and inwardly of the associated steel pipe 41, but it may be bulged only inwardly or only outwardly thereof.

Figure 20A:
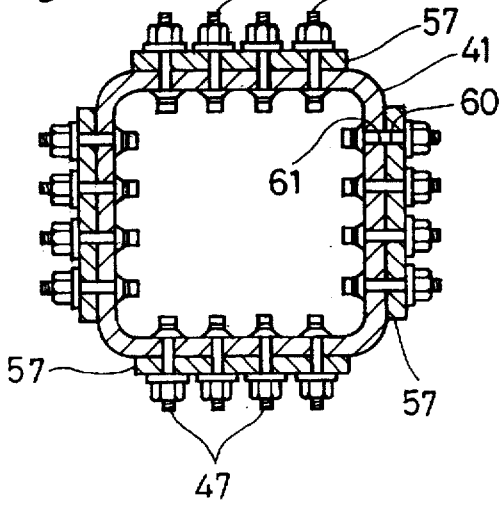
FIGS. 20(A), 20(B) and 20(C) are transverse sectional, front elevational and longitudinal sectional views, respectively, showing a first preferred embodiment of a first end-to-end connecting method of the present invention.

Each of the connecting members 57 is in the form of a generally rectangular steel plate and is, as shown in FIG. 20(A), affixed to each of four side faces of the respective square steel pipe 41. Both of the connecting members 57 and the respective thickened wall areas 41*a* of the square steel pipes 41 are formed with bolt holes 60 and 61 for passage of the associated one-side bolts 47. The steel pipes 41 so connected in end-to-end fashion as hereinabove described may be used as a steel pipe column for a building. In such case, insertion and fastening of the one-side bolts 47 to connect the steel pipes 41 together is carried out at the site of construction.

According to this connecting method, since the end of each of the steel pipe columns 41 to be axially connected with each other is defined by the thickened wall area 41*a*, and even though a number of bolt holes 61 are formed in that thickened wall area 41*a* accompanied by losses of the walls corresponding in position to the bolt holes, it is possible to secure a sectional strength comparable to that exhibited by the steel pipe column having no thickened wall area to thereby accomplish a firm end-to-end connection of the steel pipe columns 41. Also, since the one-side bolts 47 are used for the end-to-end connection of the steel pipe columns 41, no job of installing nuts inside each of the steep pipe columns 41 and/or forming screw threads is needed and the steel pipe columns 41 can readily be connected together at the site of construction even where they are used as steel pipe columns. A one-side bolt 47 capable of giving rise to a fastening force comparable to that exhibited by a high strength bolt has been developed and, therefore, the use of such one-side bolt 47 is effective to accomplish a rigid connection. In this way, the formation of the thickened wall area 41*a* in each steel pipe column 41 in combination with the use of the one-side bolts 47 makes it possible to render the structure to be simple and also to accomplish a firm end-to-end connection through a simplified connecting procedure.

Figure 20D:
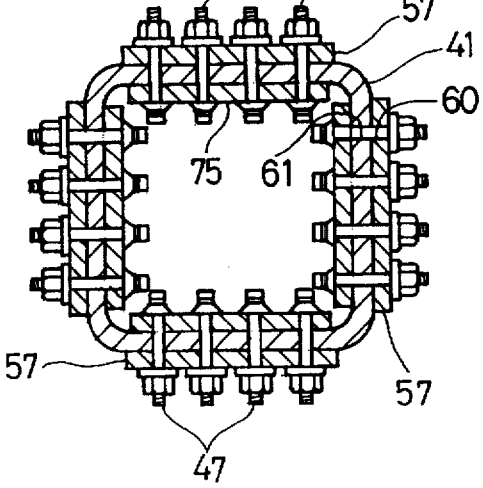
FIG. 20(D) is a diagram showing a modification of the first end-to-end connecting method.
Figure 20B:
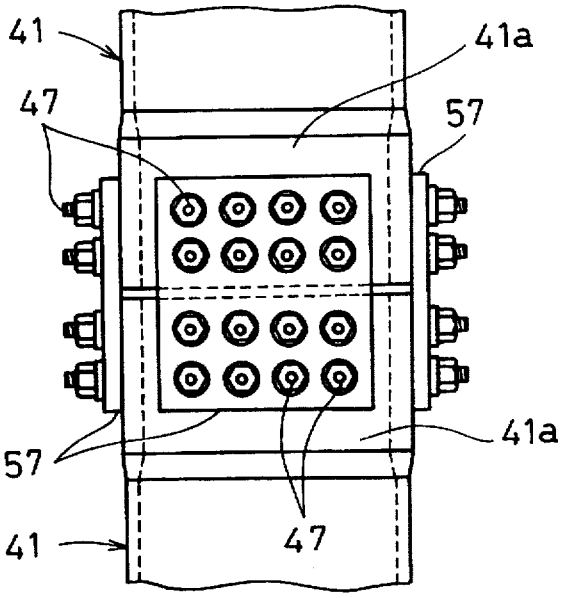
Figure 20C:
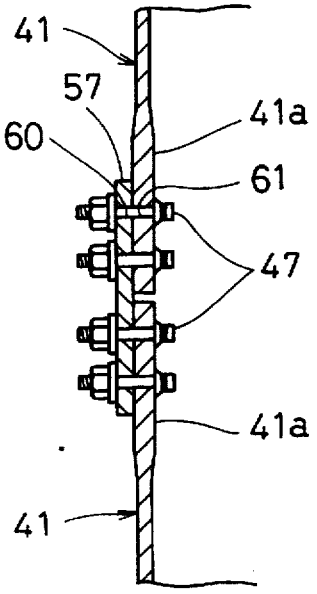

FIG. 20(D) shows a modification of the first embodiment shown in FIGS. 20(A) to 20(C), wherein bridge plates 75 are additionally employed inside the hollow of the steel pipe columns 41 adjacent the joint therebetween.

Figure 21A:
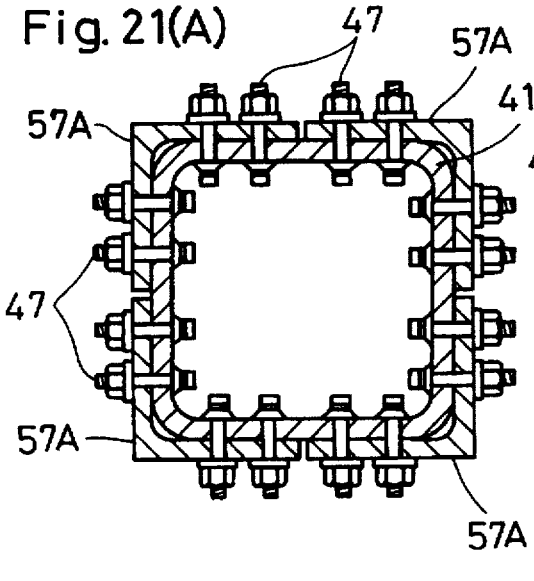
FIGS. 21(A) and 21(B) are transverse sectional and front elevational views, respectively, showing a second preferred embodiment of the first end-to-end connecting method of the present invention.
Figure 21B:
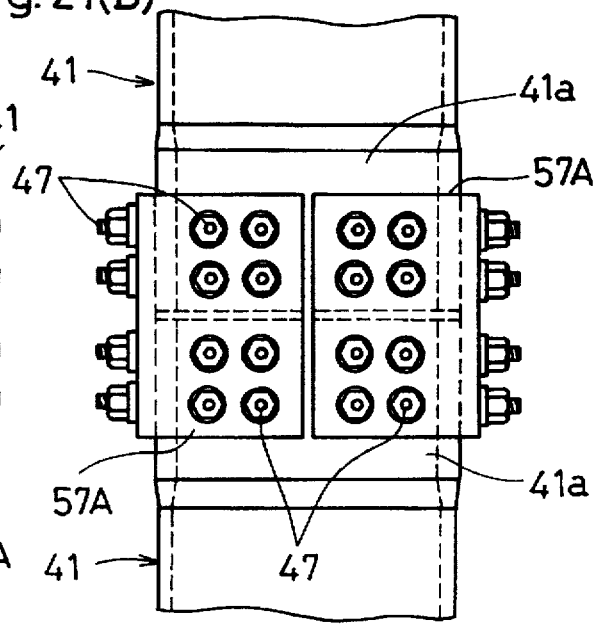

FIGS. 21(A) and 21(B) illustrate a second preferred embodiment of the method of connecting the square steel pipe columns 41 together in end-to-end fashion. According to this connecting method, connecting members 57A each in the form of an angle member are installed at respective corners of the joint between the steel pipe columns 41 and are then fastened the thickened wall areas 41*a* of the respective steel pipe columns 41 by the use of one-side bolts 47. Except for this feature, other structural features of the embodiment of FIGS. 21(A) and 21(B) are substantially similar to those shown in and described with reference to FIG. 20.

Figure 21C:
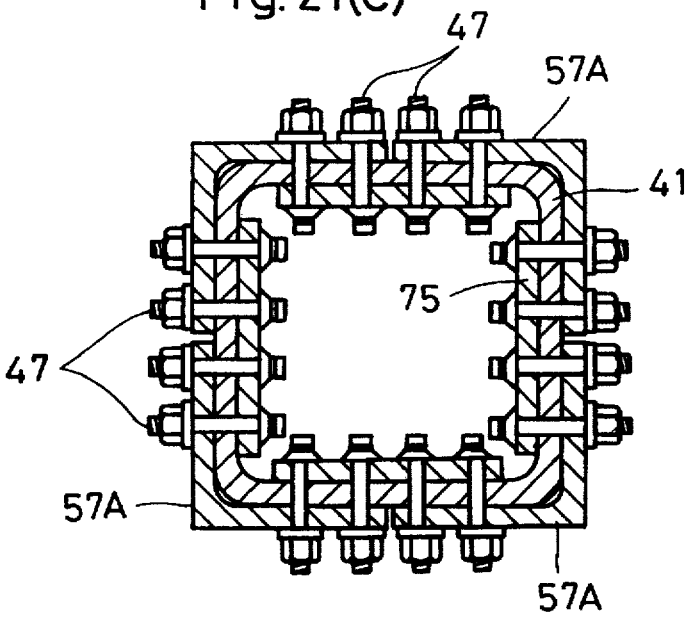
FIG. 21(C) is a transverse sectional view showing a third preferred embodiment of the first end-to-end connecting method of the present invention.

FIG. 21(C) illustrates a third preferred embodiment of the method of connecting the square steel pipe columns 41, which is similar to that shown in and described with reference to FIGS. 21 (A) and 21(B), but differs therefrom in that bridge plates 75 are additionally employed inside the hollow of the steel pipe columns 41 adjacent the joint therebetween.

It is to be noted that, although in describing the methods shown in FIGS. 20 and 21 reference has been made to the use of the square steel pipe columns 41, they can be equally applicable to the use of the round steel pipe columns. It is also to be noted that, in place of the use of the one-side bolts 47, standard bolts and nuts or standard high strength bolts may be employed. It is again to be noted that connecting members similar to the connecting members 57A may be employed and may be disposed within the hollow of the connected steel pipe columns 41 to sandwich the thickened wall areas 41*a* between the outer and inner connecting members. Furthermore, the degree of wall thickening, that is, the extent to which the wall of the steel pipe is increased in a direction transverse to the longitudinal axis thereof, may be different between the thickened wall areas 41*a* of the respective steel pipe columns 41 and, in such case, any possible gap which would be formed between each connecting member 57 and the thickened wall area 41*a* having a smaller degree of wall thickening should be filled up by a liner plate.

Figure 22:
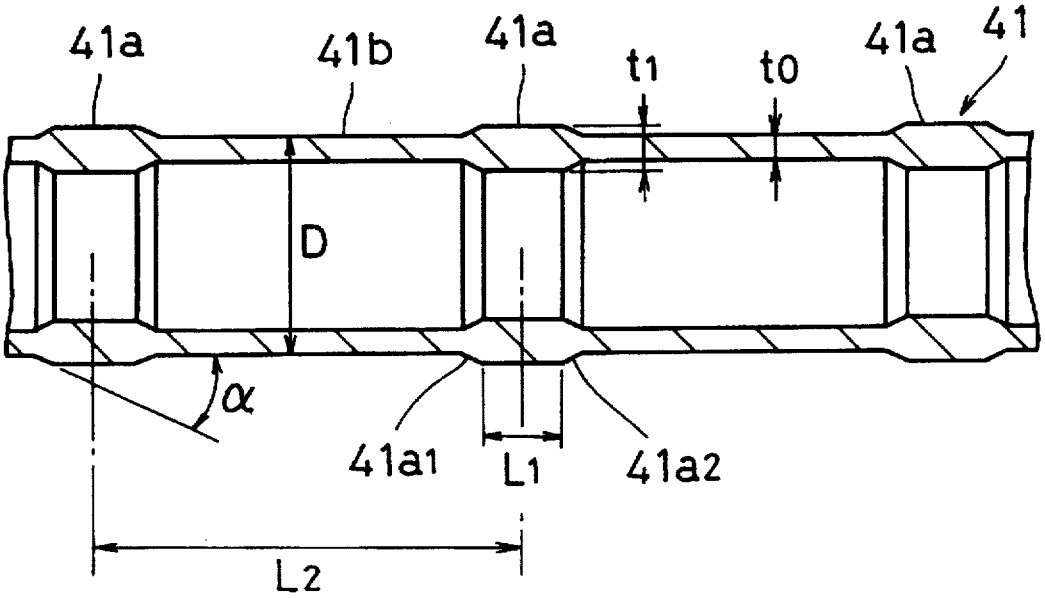
FIG. 22 is a longitudinal sectional view showing the elongated metallic member manufactured by a second manufacturing method of the present invention.
Figure 23:
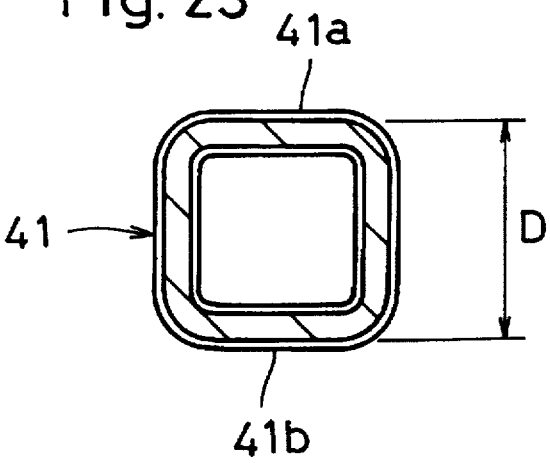
FIG. 23 is a transverse sectional view of the elongated metallic member shown in FIG. 22.

FIG. 22 is a longitudinal sectional view showing an elongated metallic member 41 manufactured according to the second method of the present invention. This elongated metallic member 41 has a plurality of axially spaced wall portions subjected to the wall thickening process to form the respective thickened wall areas 41*a* that are spaced from each other in a direction axially thereof, each of said thickened wall area 41*a* having gradient portions $41a_1$ and $41a_2$ at respective regions between it and non-thickened wall areas 41*b* of the elongated metallic member 41. This elongated metallic member 41 has a square section as shown in FIG. 23 and is adapted for use as an architectural skeleton column. It is to be noted that the thickened wall areas 41*a* are formed not only at a generally intermediate portion of the elongated metallic member 41, but also at opposite ends thereof, and therefore, the thickened wall areas 41*a* at the opposite ends of the elongated metallic member 41 are utilized for connection with a beam such as an H shape steel beam, for connection thereof to a foundation or a ceiling or for end-to-end connection of the two elongated metallic members 41 and are so thickened in wall thickness to secure a necessary strength for the intended connection purpose. More specifically, assuming that the wall thickness of the thickened wall area 41*a* is expressed by $t_1$ and the wall thickness of the non-thickened wall area is expressed by $t_o$, the magnification of wall thickening ($=t_1/t_o$) of the thickened wall area 41*a* is chosen to be within the range of 1.2 to 3.6, and preferably within the range of 1.5 to 2.5.

The axial length of the thickened wall area 41*a* is chosen to correspond to the length occupied by the beam that is connected to the elongated metallic member 41. For example, assuming that the length of the thickened wall area 41*a* is expressed by $L_1$ and the outer lateral dimension of the non-thickened wall area 41*b* is expressed by D, the ratio of the length of the thickened wall area 41*a* relative to the outer dimension of the non-thickened wall area 41*b*, that is, $L_1/D$, is chosen to be within the range of 1.1 to 4.0. Also, the angle of inclination $\alpha$ of each of the gradient portions $41a_1$ and $41a_2$ relative to the longitudinal axis of the elongated metallic member 41 is chosen to be within the range of 5° to 45°, and preferably within the range of 5° to 30°.

Figure 24:
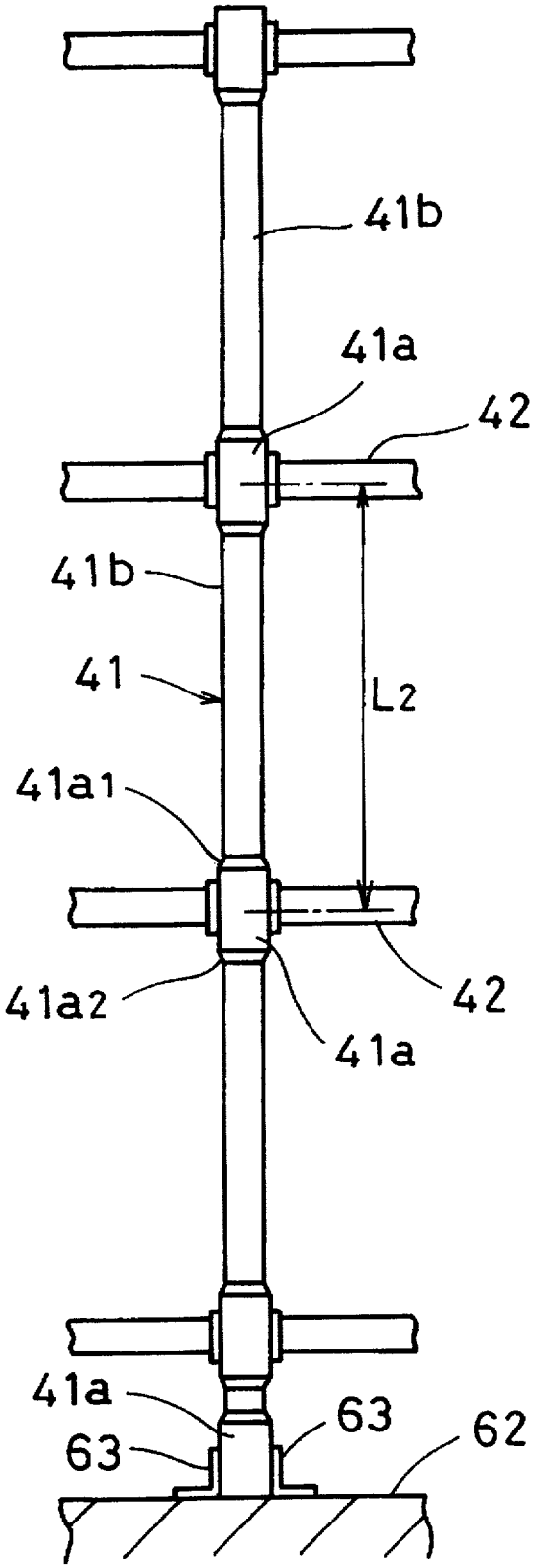
FIG. 24 is a front elevational view showing an example in which the elongated metallic member shown in FIG. 22 is used as an architectural skeleton pilar and is connected with beams.

As shown in FIG. 24, if the elongated metallic member 41 is used as an architectural skeleton column for a building, the thickened wall areas 41*a* of the elongated metallic member 41, except for the thickened wall area at the lowermost end of the elongated metallic member 41, are formed at respective positions corresponding to floor beams 42 that define associated floors of the building. The thickened wall area 41*a* at the lowermost end of the elongated metallic member 41 is then secured to a foundation 62 by means of fixtures 63. Because of this, no back-up metal piece need be used, facilitating a building construction. As described above, the other thickened wall areas 41*a* are used for connection with the respective floor beam 42.

Thus, the elongated metallic member 41 according to the foregoing embodiments can be used as an architectural skeleton column that extends through the plural stories of a building and, at this time, beam connection and securement to the foundation 62 can easily be accomplished. Therefore, the use of the elongated metallic member 41 according to the foregoing embodiments is effective to reduce the number of work steps of building construction. It is to be noted that the thickened wall areas 41*a* associated with the respective stories of a building may have varying degrees of wall thickening in such a way that the thickened wall area 41*a* used to connect with the beam associated with the highest story may have a minimum degree of wall thickening while the thickened wall area 41*a* used to connect with the beam associated with the lowest story may have a maximum degree of wall thickening.

The center-to-center spacing $L_2$ between each neighboring thickened wall areas 41*a* generally corresponds to the spacing between the neighboring stories of the building and is generally within the 2.0 to 10.0 meters considering the standard building design and building experiences. Also, the axial length $L_1$ (FIG. 22) of each thickened wall area 41*a* for connection with the beam 42 may be within the range of 600 to 1200 mm. In consideration of these dimensional particulars, the spacing between the neighboring beams and the beam dimension, the ratio of the center-to-center spacing $L_2$ between each neighboring thickened wall areas 41*a* relative to the axial length $L_1$ of each thickened wall area 41*a*, that is, $L_2/L_1$, is chosen to be within the range of about 3.3 to about 8.3. Conversely, the ratio of the axial length $L_1$ of each thickened wall area 41*a* relative to the center-to-center spacing $L_2$ between each neighboring thickened wall areas 41*a*, that is, $L_1/L_2$, may be chosen to be within the range of about 0.12 to about 0.30.

Figure 25:
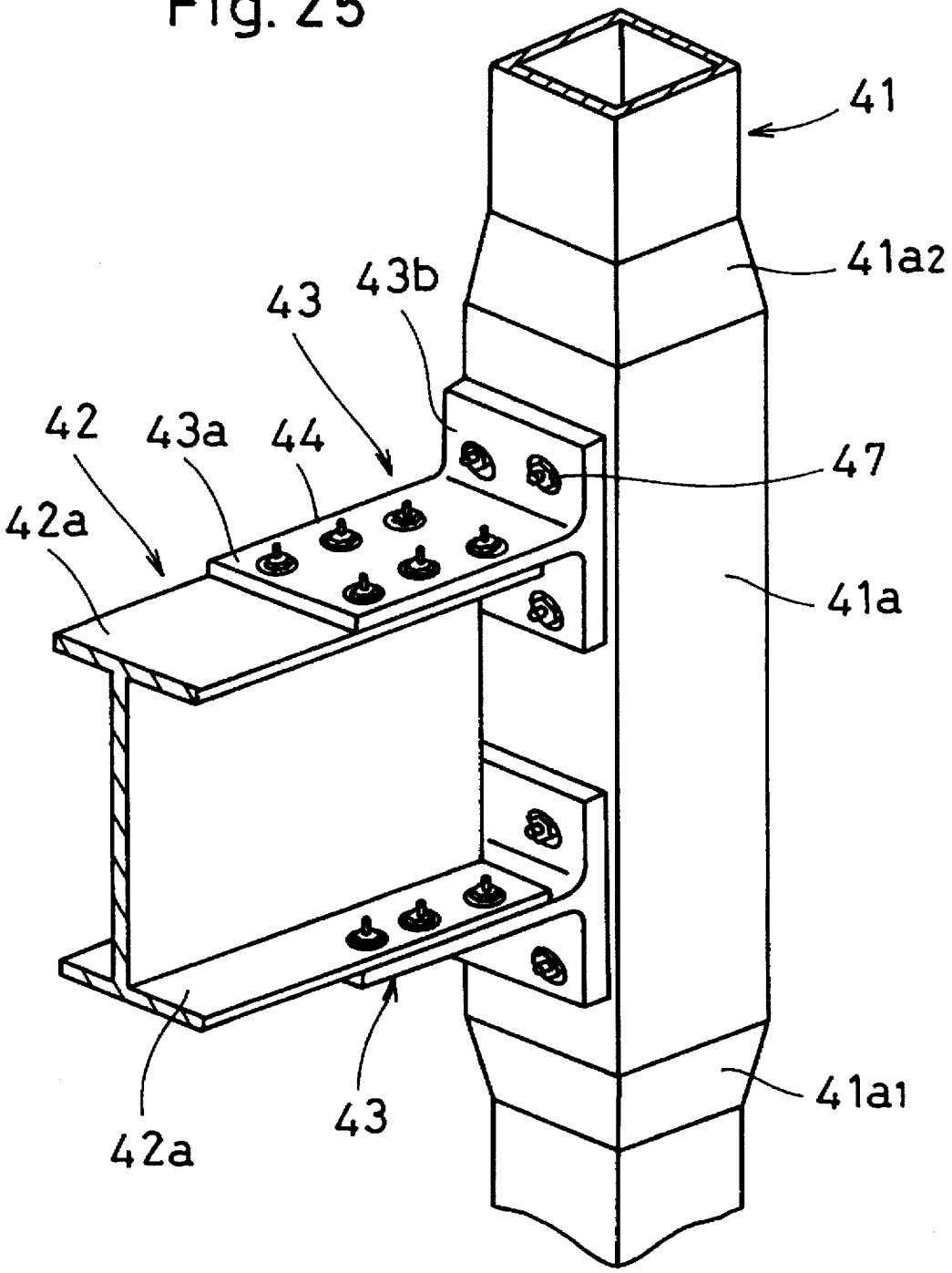
FIG. 25 is a perspective view showing a first preferred embodiment of a third beam-to column connecting method of the present invention in which the elongated metallic member manufactured by the second manufacturing method is employed.

FIG. 25 illustrates a first preferred embodiment of the third method of connecting the elongated metallic member 41, manufactured by the second wall thickening method of the present invention, with the beam, in which the elongated metallic member 41 is used as a column. According to this embodiment, other than the feature in which the respective rectangular bases 43*b* of the split tee members 43 are secured to the thickened wall area 41*a* of the elongated metallic member 41 by the use of the one-side bolts 47 inserted through bolt holes defined in the thickened wall area 41*a*, the structure shown therein is substantially similar to that shown in FIG. 7.

It is to be noted that the system of connecting the beam 42 to the architectural skeleton column employed in the form of the elongated metallic member 41 may be varied suitably. For example, the beam may be welded through an end plate and, even in such case, by connecting it to the thickened wall area 41*a*, a weld connection is possible with no need to use any back-up metal piece nor any reinforcement member.

Figure 26:
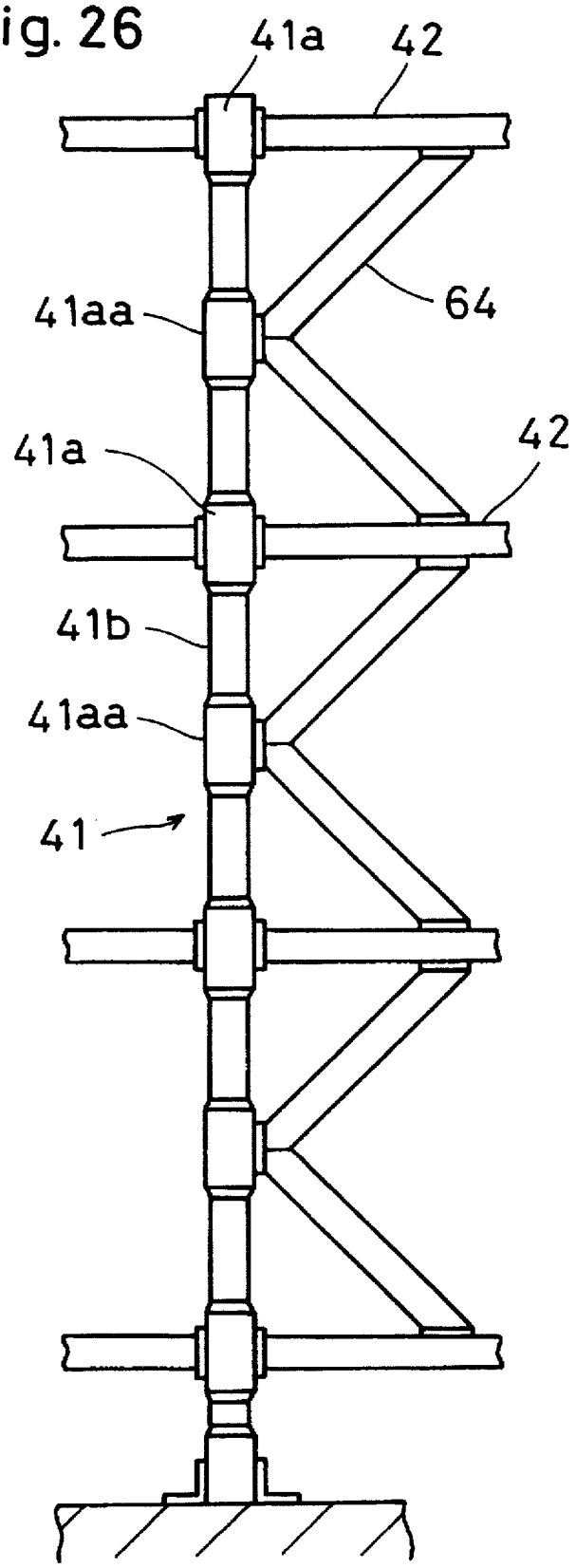
FIG. 26 is a front elevational view showing a second preferred embodiment of the third beam-to-column connecting method of the present invention.
Figure 27:
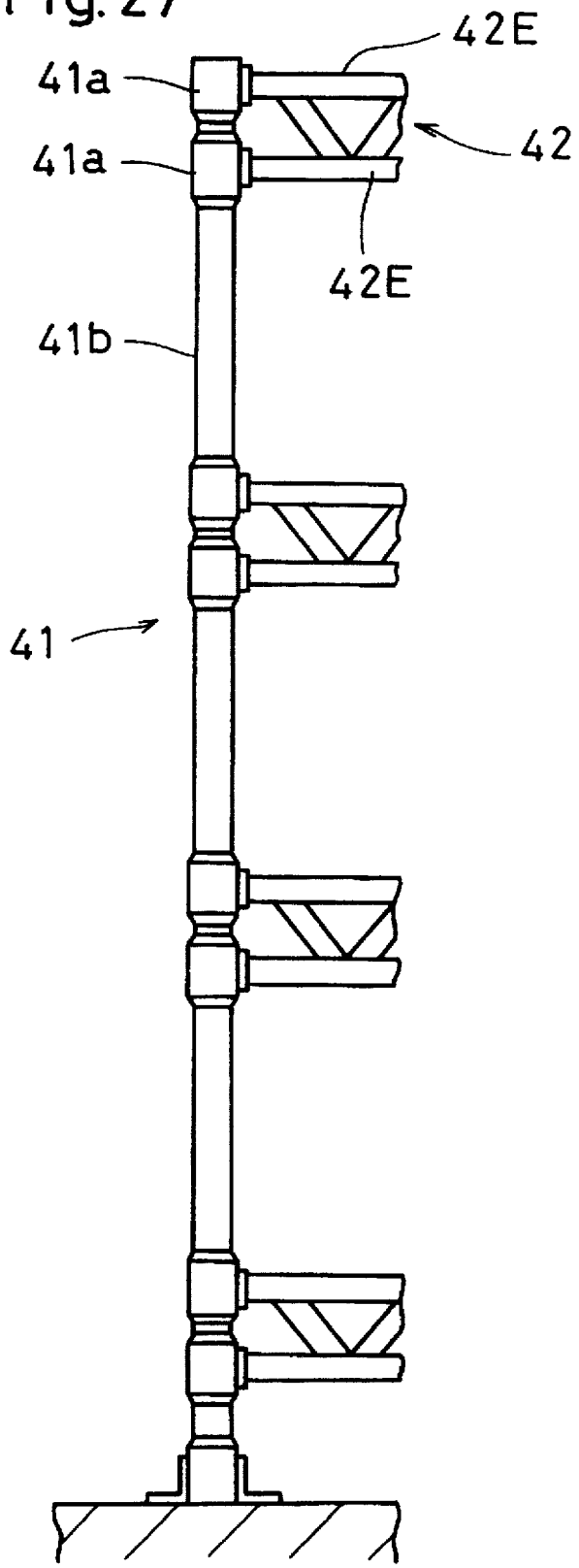
FIG. 27 is a front elevational view showing a third preferred embodiment of the third beam-to-column connecting method of the present invention.

The elongated metallic member 41 shown in FIG. 22 is of a design wherein the thickened wall areas 41*a* are equidistantly formed at respective positions where the corresponding beams 42 are to be connected. However, the positions at which the thickened wall areas 41*a* are formed may not be limited to those shown and may be chosen as desired. FIGS. 26 and 27 illustrate second and third preferred embodiments of the present invention, respectively, in which the elongated metallic member 41 having the thickened wall areas 41*a* formed at different positions in the elongated metallic member 41 is employed. According to the embodiment shown in FIG. 26, a portion of the elongated metallic member 41 between each neighboring thickened wall areas 41*a* for connection with the associated beam 42 is formed with a similar thickened wall area 41*aa* for securement of a corresponding brace 64 used to reinforce the associated beam 42. This thickened wall area 41*aa* is formed in a manner similar to the formation of the thickened wall area 41*a* and is readily utilizable for securement of the brace 64 thereto. On the other hand, according to the embodiment shown in FIG. 27, the elongated metallic member 41 shown therein is of a type used in a building in which two parallel beam bars 42E are used for each beam 42 and, because of this, thickened wall areas 41*a* are formed on the elongated metallic member 41 at respective positions corresponding to the two parallel beam bars 42E for each beam 42. Even in this elongated metallic member 41, the parallel beam bars 42E can easily be connected to the thickened wall areas 41*a*.

Figure 28A:
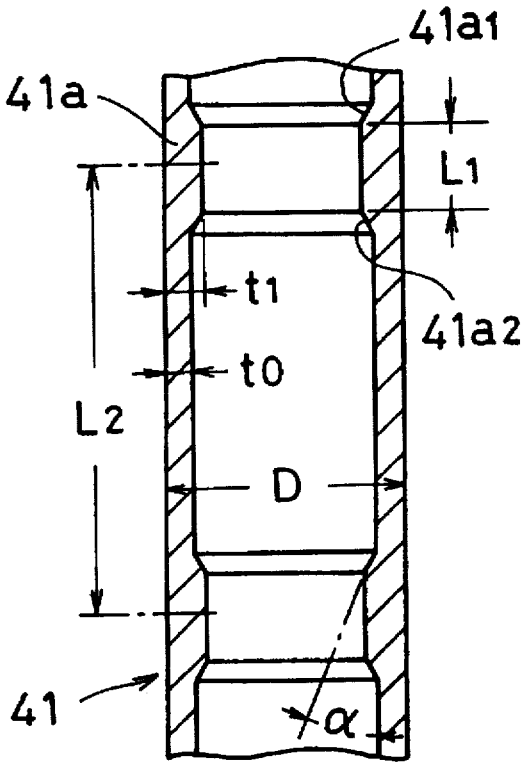
FIGS. 28(A) and 28(B) are longitudinal sectional views, respectively, showing different forms of the steel pipe column used in the practice of the third beam-to-column connecting method of the present invention.
Figure 28B:
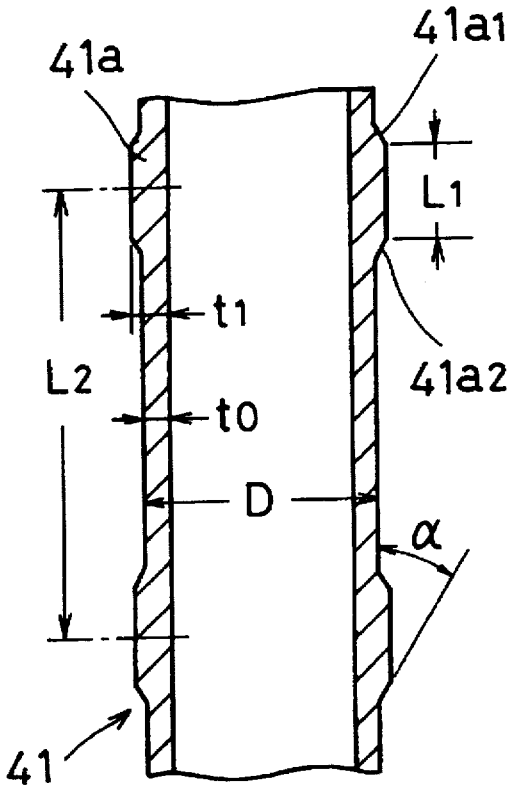

It is to be noted that, in the foregoing embodiment of the present invention shown in FIG. 22, the elongated metallic member 41 has been shown and described as having at least one thickened wall area 41*a* which protrude inwardly and outwardly of the wall of the metallic member 41. However, the thickened wall area 41*a* may be of a design which protrude only inwardly, as shown in FIG. 28(A), or only outwardly, as shown in FIG. 28(B), of the wall of the elongated metallic member 41. Even in this case, the magnification of wall thickening ($=t_1/t_0$), the ratio of the thickened wall area 41*a* ($=L_1/D$), the angle of inclination $\alpha$, all discussed hereinbefore, are equally applied to the elongated metallic member 41 employed in the practice of any one of the foregoing embodiments shown in FIGS. 28(A) and 28(B).

Manufacture of the elongated metallic member 41 referred to above is carried out by the use of the wall-thickening apparatus shown in FIG. 4, in a manner similar to that described with reference to FIGS. 1 to 6.

Figure 29A:
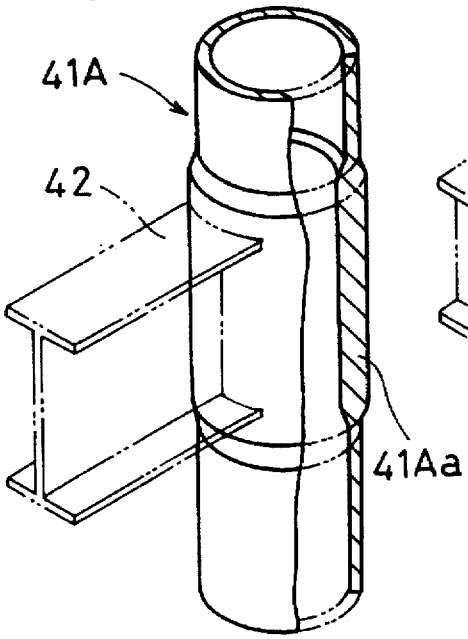
FIGS. 29(A) to 29(C) are perspective views showing different forms of connection according to respective modifications of the third beam-to-column connecting method of the present invention in which the elongated metallic member manufactured by the second manufacturing method of the present invention is used as an architectural skeleton column.

In any one of the embodiments shown in FIGS. 25 to 28, application of the second manufacturing method shown in FIG. 22 to the square steel pipe has been shown. However, the second manufacturing method shown in FIG. 22 is equally applicable to any other steel member such as, for example, a round steel pipe, a shape steel (an H shape steel, an I shape steel or a channel steel) and also to any other elongated metallic member made of material other than steel. FIG. 29(A) illustrates an embodiment in which the elongated metallic member 41A is in the form of a round steel pipe having at least one thickened wall area 41*a* of a design protruding radially inwardly and outwardly. The beam 42 to be connected to the thickened wall area 41*a* of the elongated metallic member 41A has an arcuate end plate 49A and is connected to the thickened wall area 41*a* by the use of bolts passing through the arcuate end plate 49A.

Figure 29B:
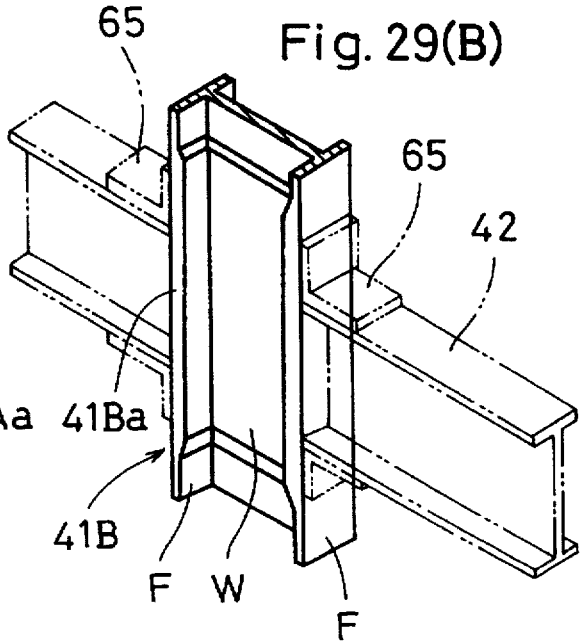

FIG. 29(B) illustrates the elongated metallic member 41B in the form of an H shape steel having at least one thickened wall area 41B*a* formed on inner surfaces of opposite flanges F and each surface of a web W. The beam 42 used therein is bolted to the thickened wall area 41B*a* of the elongated metallic member 41B by the use of angle members 65. It is to be noted that, in place of the use of the angle members 65, split tee members may be used. In the case of the elongated metallic member 41B in the form of the H shape steel such as shown in FIG. 29(B), the thickened wall area 41B*a* may, other than that shown, be formed only at the flanges F or at the web W and may also be formed so as to protrude outwardly from one surfaces thereof or from both of the opposite surfaces thereof.

Figure 29C:
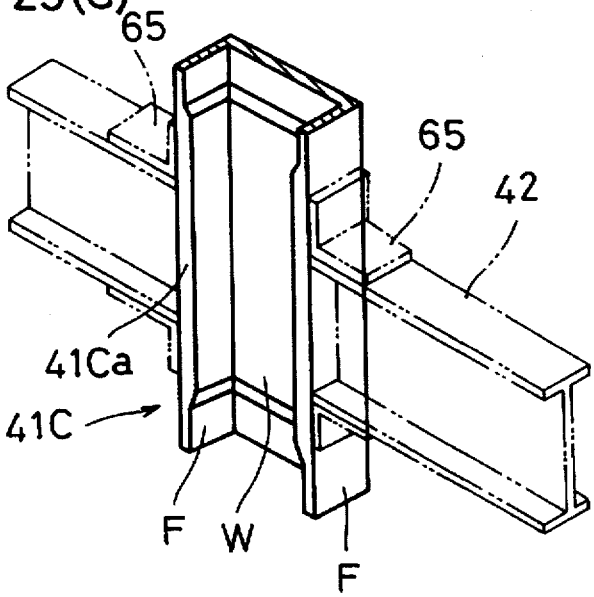

The use of the channel steel for the elongated metallic member 41C is shown in FIG. 29(C). In this example of FIG. 29(C), at least one thickened wall area 41C*a* is formed only on one surface thereof. The beam 42 is bolted to the thickened wall area 41C*a* with the use of angle members 65. It is to be noted that, in place of the use of the angle members 65, split tee members may be employed. Even in this case, the thickened wall area 41C*a* may, other than that formed on the inner surface of the elongated metallic member 41C, be formed on opposite surfaces thereof or on an outer surface thereof. Also, the thickened wall area 41C*a* may be formed only on the flanges F or on the web W.

In any one of the embodiments shown in FIGS. 29(A) to (C), respectively, one end of the beam 42 that is connected to the elongated metallic member 41A, 41B or 41C may be formed with a thickened wall area for reinforcement purpose.

The metallic member 41 so manufactured as shown in FIG. 22 may be employed in the practice of any one of the connecting methods shown respectively in FIGS. 7 to 12 and 16 to 19 and of any one of the end-to-end connecting methods shown respectively in FIGS. 20 and 21.

Figure 30:
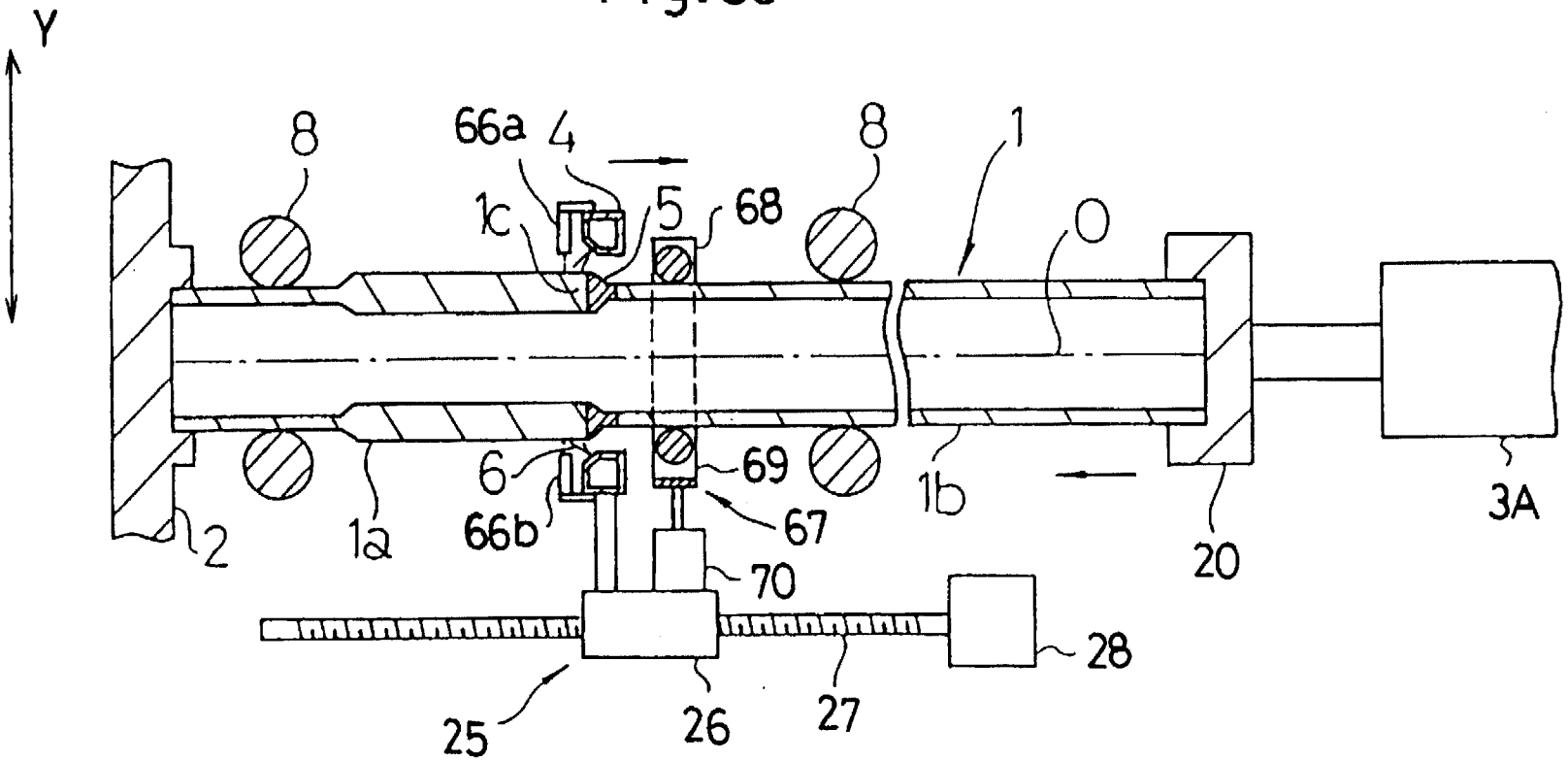
FIG. 30 is a longitudinal sectional view of the wall-thickening apparatus used in the practice of a third manufacturing method of the, present invention.
Figure 31:
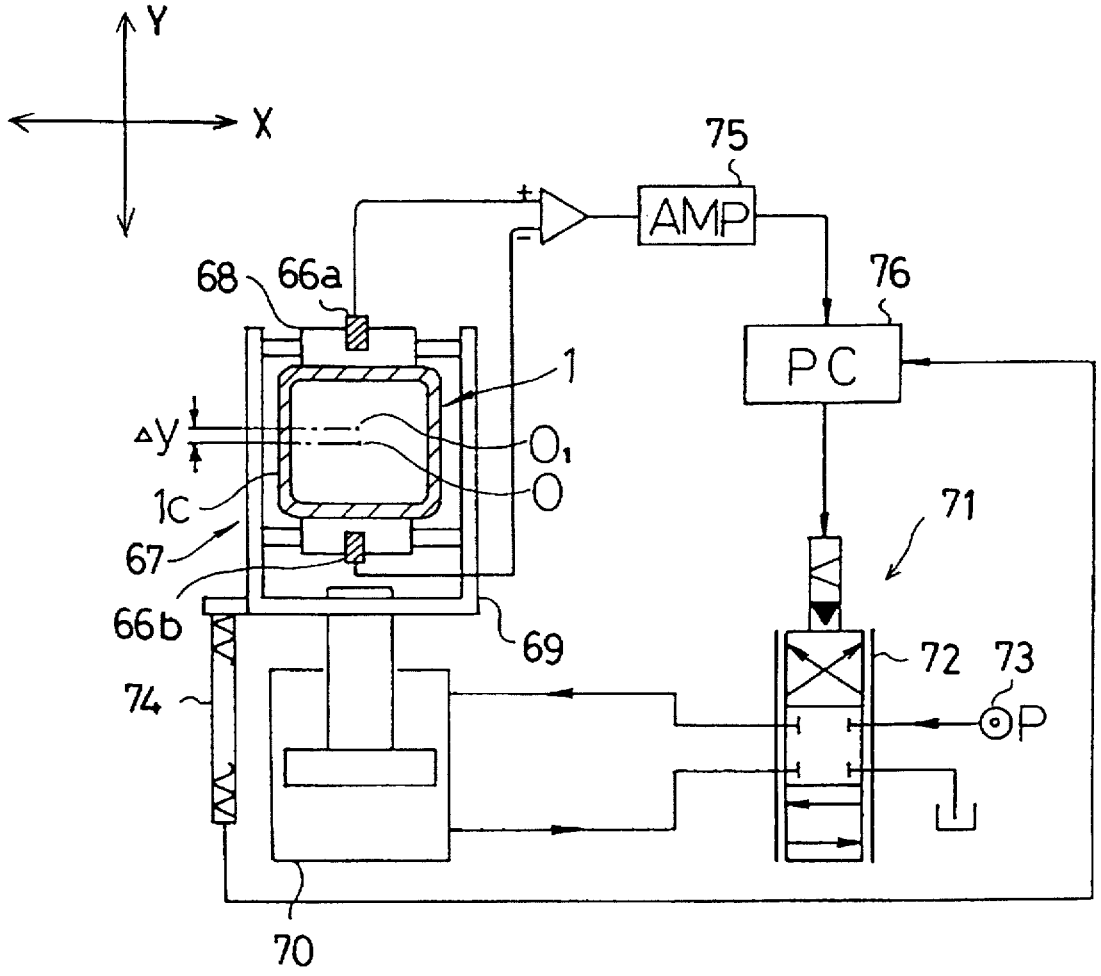
FIG. 31 is a transverse sectional view of the wall-thickening apparatus shown in FIG. 30.

FIGS. 30 to 32 illustrate a first preferred embodiment of a third method of manufacturing an elongated metallic member according to the present invention. FIG. 30 is a schematic longitudinal sectional view showing a wall-thickening apparatus and FIG. 31 is a schematic structural diagram showing an Y-axis rectifying device used in the wall-thickening apparatus for correcting a vertical bending of the elongated metallic member set horizontally in the wall-thickening apparatus. Referring now to FIGS. 30 and 31, the elongated metallic member 1 to be subjected to the wall thickening process is a square pipe.

In the illustrated wall-thickening apparatus, guide roller pairs 8 serve as constraint roller pairs for constraining the elongated metallic member 1 so as to extend straight in a direction in which it is axially compressed. While in practice guide rollers forming the guide roller pairs 8 are disposed above and below the elongated metallic member 1 and also on respective lateral sides of the elongated metallic member 1, only the guide rollers of the guide roller pairs 8 which are disposed above and below the elongated metallic member 1 are shown in FIG. 30 for the sake of clarity. Except for an Y-axis rectifying device, the other structural components of the wall-thickening apparatus shown in FIGS. 30 and 31 are similar to those shown in FIG. 4 and, therefore, the details thereof are not reiterated for the sake of brevity.

Displacement sensors 66*a* and 66*b* for detecting displacement of opposite surfaces of the elongated metallic member 1 in a Y-axis direction are so disposed as to confront upper and lower surface of a portion 1*c* of the elongated metallic member 1 immediately following a heated area of the elongated metallic member 1. These displacement sensors 66*a* and 66*b* are carried by the heating unit 4 for movement together therewith in a lengthwise direction of the elongated metallic member 1, but may be secured to the carriage 26. Since these displacement sensors 66*a* and 66*b* constantly detect displacement of the opposite surfaces of the elongated metallic member 1 which they confront, a difference between respective detection outputs from these displacement sensors 66*a* and 66*b* provides an indication of the quantity of displacement $\Delta Y$ of the elongated metallic member 1 in the Y-axis direction which is a direction orthogonal to the longitudinal axis O of the elongated metallic member 1. The quantity of displacement $\Delta Y$ referred to above represents the distance in the Y-axis direction between the longitudinal axis O of the elongated metallic member 1 and the position $O_1$ to which the longitudinal axis O of that portion 1*c* of the elongated metallic member 1 immediately following the heated area thereof as shown in FIG. 31. Accordingly, the displacement sensors 66*a* and 66*b* altogether constitute a displacement detecting means for detecting displacement of that portion 1*c* of the elongated metallic member 1 immediately following the heated area thereof relative to the longitudinal axis O of the elongated metallic member 1.

Although detection of the displacement quantity $\Delta Y$ is possible with the use of only one of the displacement sensors 66*a* and 66*b*, the quantity of the wall thickened during the practice of the wall thickening process tends to vary and change in quantity of the wall thickened often mingles in the displacement quantity $\Delta Y$ as an error. Therefore, the use of the two displacement sensors 66*a* and 66*b* for detecting displacement of the upper and lower surfaces of the elongated metallic member 1, respectively, is effective to ensure a high accuracy of detection. Each of the displacement sensors 66*a* and 66*b* employable in the practice of the present invention may be of any known sensor such as, for example, a non-contact distance measuring instrument utilizing a laser beam, a distance measuring instrument utilizing an electric eddy current, a contact electric micrometer, a differential transformer and so on.

Slight displacement in cross-cross section of the heated area 5 under the influence of thermal stresses extensively occurs at the heated area 5 (a zone from a position immediately below the heating unit 4 to the position at which the cooling medium 6 is sprayed) and is enhanced at that portion 1*c* of the elongated metallic member 1 immediately following the heated area thereof. For this reason, the displacement sensors 66*a* and 66*b* are preferably disposed at the position where the cooling medium 6 is sprayed or in a zone of about 5 cm from such position.

A bend rectifying means 67 includes a pair of clamp rollers 68 disposed above and below a non-thickened wall area 1*b* of the elongated metallic member 1, respectively, a movable frame 69 carrying the clamp rollers 68, a hydraulic cylinder 70 for driving the movable frame 69 in the Y-axis direction and so on. Accordingly, the bend rectifying means 67 is movable together with the heating unit 4 while maintaining a predetermined distance of spacing between it and the heating unit 4. The clamp rollers 68 are preferably positioned as close towards the heating unit 4 as possible and are positioned in the vicinity of the heating unit 4 without interfering the latter. It is to be noted that, instead of the design in which the bent rectifying means 67 is mounted on the carriage 26 together with the heating unit 4, the use may be made of an additional carriage for the support of the bend rectifying means 67 provided that such additional carriage is supported for movement in unison with the heating unit 4.

A control unit 71 for the hydraulic cylinder 70 shown in FIG. 31 includes a hydraulic servo valve 72 for controlling the hydraulic cylinder 70, a source 73 of a hydraulic medium, a position sensor 74 for detecting the position of the movable frame 69 carrying the clamp rollers 68 with respect to the Y-axis direction, a signal converter 75 for converting the respective detection outputs from the displacement sensors 66*a* and 66*b*, a comparing arithmetic unit 76 and others. The comparing arithmetic unit 76 receives an output signal from the signal converter 75 which represents the quantity $\Delta Y$ of displacement of that portion 1*c* of the elongated metallic member 1 immediately following the heated area thereof in the Y-axis direction. This comparing arithmetic unit 76 monitors a position signal fed back from the position sensor 74 to control the hydraulic servo valve 72 in operating the hydraulic cylinder 70. Specifically, in the event that the displacement quantity $\Delta Y$ exceeds a predetermined tolerance, the comparing arithmetic unit 76 outputs to the hydraulic servo valve 72 a drive signal necessary to drive the clamp rollers 68 in a direction counter to the direction of displacement so that the displacement quantity $\Delta Y$ can be reduced to a value within a predetermined tolerance.

The displacement sensors 66*a* and 66*b*, the bend rectifying means 67, the control unit 71 for controlling the bend rectifying means 67 and others constitute the Y-axis rectifying device for correcting a bend of the elongated metallic member 1 in the Y-axis direction. It is to be noted that, although not shown, the use is in practice made of an X-axis rectifying device for correcting a bend of the elongated metallic member 1 in an X-axis direction perpendicular to the Y-axis direction and also to the longitudinal axis of the elongated metallic member 1, that is, in a horizontal plane. This X-axis rectifying device is to be understood as being of a structure substantially identical with the Y-axis rectifying device.

The wall thickening process performed by the wall-thickening apparatus shown particularly in FIGS. 30 and 31 will now be described.

At the outset, as shown in FIG. 30, the elongated metallic member 1 in the form of a square pipe is set in the wall-thickening apparatus with their opposite ends secured respectively to the tailstock 2 and the clamp 20 drivingly coupled with the pusher 3A. While the elongated metallic member 1 so supported in the wall-thickening apparatus is axially inwardly pressed by the pusher 3A such as, for example, a hydraulic cylinder, through the clamp 20, consecutive portions of the elongated metallic member 1 are successively heated by the heating unit 4 over the length thereof to a plasticizable temperature, i.e., a temperature at which the heated wall of the metallic member 1 can undergo a plastic deformation, thereby forming the heated area 5. Continued axial inward compression of the elongated metallic member 1 results in that portion of the elongated metallic members, which is then heated, to undergo the plastic deformation to eventually form a thickened wall area which extends a predetermined axial distance as the heating unit 4 is moved along the elongated metallic member 1. Simultaneous with the movement of the heating unit 4, the cooling medium 6 is sprayed onto that portion 1*c* of the elongated metallic member immediately following the heated area to cool and solidify that portion 1*c* of the elongated metallic member 1 immediately following the heated area thereof. In this way, the thickened wall area 41*a* is formed on the elongated metallic member 1 in an axial direction as the heating unit 4 is moved along the elongated metallic member 1.

During the wall thickening taking place, a temperature variation resulting from an irregular heating and/or an irregular cooling is developed within the cross-section of the heated area of the elongated metallic member 1 and, consequently, a thermal stress difference is induced wherefore the portion of the elongated metallic member 1 including the heated area 5 may bend in a transverse direction relative to the longitudinal axis O of the elongated metallic member 1. This displacement cannot be avoided even though the guide roller pairs 8 constrain that wall-thickened portion 1*a* of the elongated metallic member 1 to a position where it ought to occupy without the displacement, partly because the spacing between the guide roller pairs 8 disposed adjacent the tailstock 2 and the heated area 5 increases as the wall thickening proceeds and partly because, in view of the space for installation of the clamp rollers 68, there is no way other than to dispose the clamp rollers 68 at a location spaced a certain distance, for example, 15 to 20 cm, from the heated area 5, and therefore, a portion of the elongated metallic member 1 encompassed between the guide roller pairs 8 adjacent the tailstock 2 and the heated area 5 and another portion of the elongated metallic member 1 encompassed between the heated area 5 and the clamp rollers 68 tends to deform.

Assuming that the portion of the elongated metallic member 1 encompassed by the heated area 5 and its vicinity bend upwardly and that that portion 1*c* of the elongated metallic member 1 immediately following the heated area thereof is also bent upwardly from the position where it ought to be, as shown in FIG. 31, by a quantity $\Delta Y$ with the longitudinal axis occupying the position $O_1$, the displacement sensors 66*a* and 66*b* detect the displacement quantity $\Delta Y$ and the detection output indicative of this displacement quantity $\Delta Y$ is outputted from the signal converter 75 to the comparing arithmetic unit 76. The comparing arithmetic unit 76 then monitoring a position signal fed back from the position sensor 74 to control the hydraulic servo valve 72 in operating the hydraulic cylinder 70 then outputs, in the event that the displacement quantity $\Delta Y$ exceeds a predetermined tolerance, to the hydraulic servo valve 72 a drive signal necessary to drive the clamp rollers 68 in a downward direction. In response to the drive signal from the comparing arithmetic unit 76, the hydraulic servo valve 72 effects the supply of the hydraulic medium to the hydraulic cylinder 70 to drive the latter so that the clamp rollers 68 are moved downwardly a distance necessary to compensate for the displacement quantity $\Delta Y$. Accordingly, the non-thickened wall area 1*b* of the elongated metallic member 1 is lowered by the clamp rollers 68. As a result, that portion 1*c* of the elongated metallic member 1 immediately following the heated area is displaced downwardly with the displacement quantity $\Delta Y$ reduced down to a value within the predetermined tolerance. Where the displacement takes place in a direction reverse to that described above, the hydraulic cylinder 70 pushes the elongated metallic member 1 upwardly to reduce the displacement quantity $\Delta Y$ down to a value within the predetermined tolerance. In this way, during the wall thickening, displacement of that portion 1*c* of the elongated metallic member 1 immediately following the heated area thereof in the Y-axis direction is always maintained within the predetermined tolerance and the wall thickening takes place with a minimized bending of the elongated metallic member 1.

Simultaneously with the rectification of the bending of the elongated metallic member 1 in the Y-axis direction, a similar rectification of the bending of the elongated metallic member 1 in the X-axis direction takes place. By these rectifications, the resultant wall-thickened elongated metallic member 1 exhibits the minimized bending in both of the Y- and X-directions.

In the foregoing description, reference has been made to the wall thickening effected to only one location in the elongated metallic member 1. However, the wall thickening may be effected to a plurality of locations in the elongated metallic member 1 and even in this case the rectification of the bending is successively carried out. In such case, the quantity of bending of the initially formed thickened wall area may be counterbalanced with that of the subsequently formed thickened wall area and, thus, the present invention is effective to provide the highly accurately wall-thickened elongated metallic member.

Figure 32A:
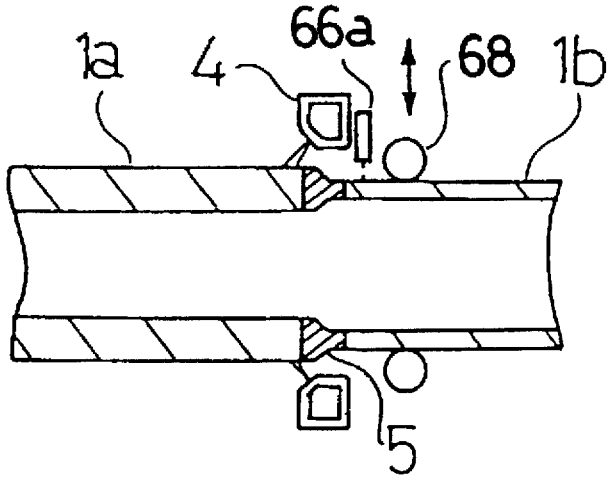
FIGS. 32(A) to 32(C) are longitudinal sectional views of the elongated metallic member illustrating respective modifications of displacement detection and lateral force acting position.

Although in the foregoing embodiment shown in and described with reference to FIGS. 30 and 31 arrangement has been made that the displacement of that portion 1*c* of the elongated metallic member 1 immediately following the heated area thereof is so detected as to allow the clamp rollers 68 of the rectifying means 76 to rectify a bending of the non-thickened wall area 1*b* of the same elongated metallic member 1, the design may not be limited thereto and the position at which the displacement is detected and the position at which the clamp rollers 68 operate may be varied if so desired. By way of example, with respect to the position at which the displacement is detected, as shown in FIG. 32(A), displacement of the non-thickened wall area 1*b* of the elongated metallic member 1 adjacent the heated area 5 may be detected by the displacement sensor 66*a*. In such case, since the non-thickened wall area 1*b* is relatively accurately tailored, the use of the two displacement sensors 66*a* and 66*b* is not always necessary and the use of one of them is sufficient.

Figure 32B:
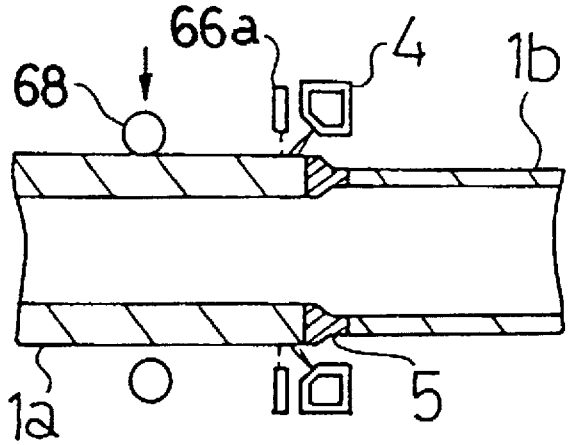
Figure 32C:
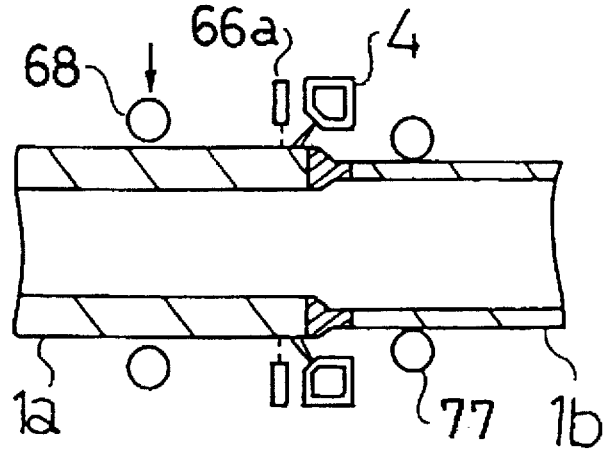

With respect to the position at which the clamp rollers 68 operate, as shown in FIG. 32(B), the clamp rollers 68 may be disposed so as to act on only the wall-thickened area 1*a*. In such case, since the spacing between the opposite surfaces of the wall-thickened area 1*a* varies with variation in wall thickening, it is necessary to have the clamp rollers 68 spaced a relatively great distance from each other. Moreover, as shown in FIG. 32(C), in the example in which the clamp rollers 68 are disposed on respective sides of the wall-thickened area 1*a*, auxiliary guide rollers 77 may be disposed adjacent the heated area 5 for movement together with the heating unit 4 for controlling the non-thickened wall area 1*b* to a predetermined position. By so constructing, displacement hardly occurs in the heated area 5 and its vicinity and, even though the displacement occurs, the clamp rollers 68 are effective to rectify the displacement and, therefore, the wall thickening with a minimized bending is possible.

Also, in the foregoing embodiment shown in and described with reference to FIGS. 30 and 31, the rectifying means 67 for applying a load to the elongated metallic member 1 to rectify the bending thereof has been shown and described as movable together with the heating unit 4 along the elongated metallic member 1. However, the rectifying means 67 need not be always supported for movement and may be installed stationary at a predetermined site. Furthermore, arrangement may be made, for example, that the guide rollers forming the guide roller pairs 8 may be supported for movement by a suitable drive means in a direction perpendicular to the longitudinal axis O of the elongated metallic member 1 and they may be concurrently used as clamp rollers of the rectifying means 67.

While in the foregoing embodiment of FIGS. 30 and 31, each of the clamp rollers 68 used in the bend rectifying means 67 has been shown as having a cylindrical shape, they may have any desired shape depending on the cross-sectional shape of the elongated metallic member 1. By way of example, if the elongated metallic member 1 is a round pipe, each of the clamp rollers 68 may be of a type having its peripheral surface concaved to follow the curvature of the round pipe. If the elongated metallic member 1 is an I shape or channel member, each of the clamp rollers 68 may be of a type having an annular groove or projection on its outer peripheral surface, respectively.

Yet, in the foregoing embodiment shown in FIGS. 30 and 31, the wall-thickened area 1*a* of the elongated metallic member on the trailing side of the heated area 5 has been shown as held immovable while the non-thickened wall area 1*b* of the same elongated metallic member 1 on the leading side of the heated area 5 and the heating unit 4 have been shown as moved vertically to the longitudinal axis O. However, the reverse may be possible in that, while the non-thickened wall area 1*b* is held immovable, the heating unit 4 and that wall-thickened area 1*a* rearwardly following the heating unit 4 may be made movable. Again, arrangement may be made that, while the heating unit 4 is held stationary, the elongated metallic member 1 including both of the wall-thickened area 1*a* and the non-thickened wall area 1*b* is supported for movement.

Although in the foregoing embodiment shown in FIGS. 30 and 31, the bend rectifying means 67 has been described as operable to apply the load to the elongated metallic member 1 in a direction perpendicular to the longitudinal axis O thereof to rectify the bending, the bend rectification is possible by imparting a bending moment M to the elongated metallic member 1. An embodiment of the present invention in which the bending moment is imparted to the elongated metallic member 1 is shown in FIG. 33.

Figure 33:
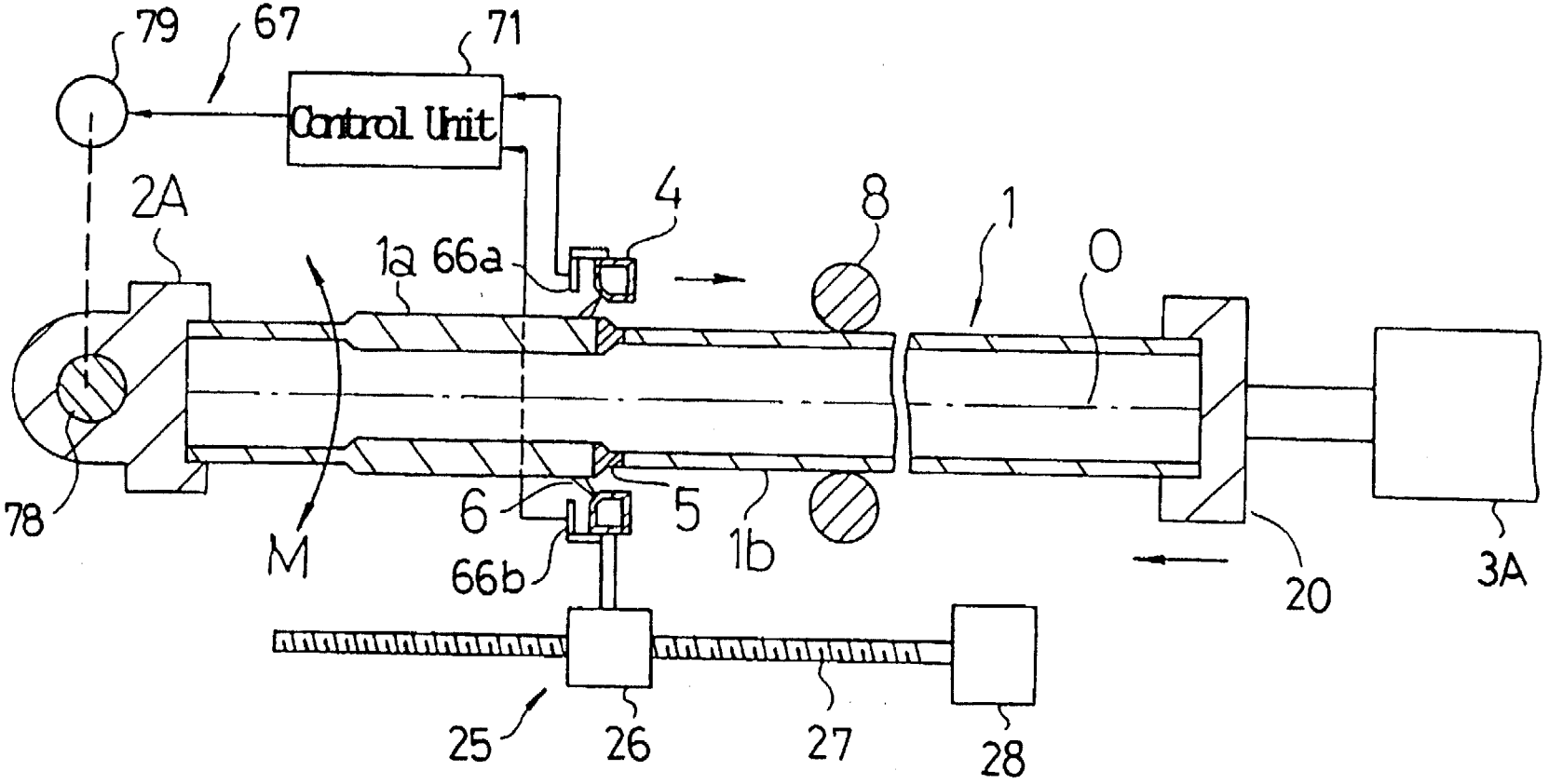
FIG. 33 is a longitudinal sectional view of a modified form of the wall-thickening apparatus.

Referring now to FIG. 33, the tailstock 2A for holding one end of the elongated metallic member 1 is mounted on a rotary shaft 78 for movement together therewith, said rotary shaft 78 being in turn drivingly coupled with a drive unit 79, so that a bending moment M can be applied to the elongated metallic member 1. In this embodiment, the tailstock 2A and the drive unit 79 constitute the bend rectifying means 67 and adapted to be controlled by the control unit 71 in response to the outputs from the displacement sensors 66*a* and 66*b* used to detect the displacement occurring in the vicinity of the heated area 5. Accordingly, in the event that the heated area 5 of the elongated metallic member 1 and its vicinity displaces by the effect of the thermal stress difference, the tailstock 2A applies the .bending moment M to the elongated metallic member 1 so that that portion of the elongated metallic member 1 then bending can be angularly moved in a direction counter to the direction in which the bending takes place. In this way, the displacement of the heated area of the elongated metallic member 1 and its vicinity can advantageously minimized, allowing the wall thickening process to proceed with a minimized bending of the elongated metallic member 1.

Figure 34:
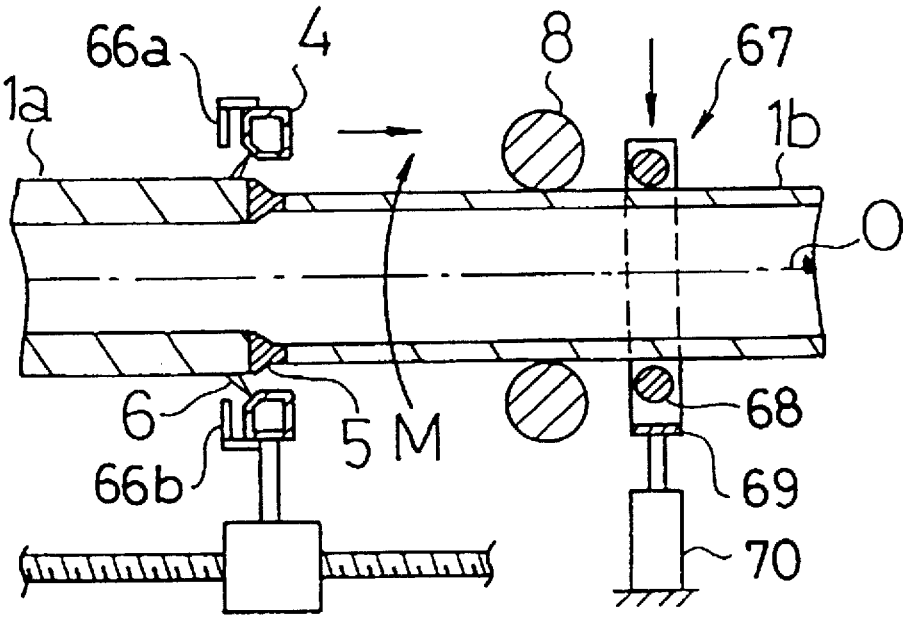
FIG. 34 is a fragmentary longitudinal sectional view showing a further modified form of the wall-thickening apparatus.

It is to be noted that the position at which the bending moment M is applied to the elongated metallic member 1 may not be always limited to the end of the elongated metallic member 1 held in contact with the tailstock 2A, but may be the other end of the elongated metallic member 1 adjacent the pusher 3A. Also, as shown in FIG. 34, the bend rectifying means 67 including the clamp rollers 68, the movable frame 69, the hydraulic cylinder 70 and others may be disposed on one side of the guide roller pair 8 opposite to the heated area 5 so that the bending moment M can be applied to the elongated metallic member 1 by causing the clamp rollers 68 to apply to the elongated metallic member 1*a* load acting in a direction perpendicular to the longitudinal axis O of the elongated metallic member 1 and also in a direction counter to the direction in which that heated area 5 of the elongated metallic member 1 and its vicinity have been displaced, thereby to minimize the displacement of the heated area 5 of the elongated metallic member 1 and its vicinity.

The elongated metallic member manufactured by the wall thickening method of the present invention by the use of the wall-thickening apparatus of the structure shown in and described with reference to FIGS. 30 to 34 can be used in the practice of the connecting method shown in any one of FIGS. 7 to 12, 16 to 19 and 24 to 27 and also the end-to-end connecting method shown in any one of FIGS. 20 and 21.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. For example, one end of the beam 42 adapted to connect to the column 41 may be wall-thickened for reinforcement purpose.

Accordingly, such changes and modifications are, unless they depart from the scope of the present invention as delivered from the claims annexed hereto, to be construed as included therein.

What is claimed is:

1. A method of manufacturing an elongated metallic member having at least one thickened wall portion, comprising the steps of:

providing an elongated metallic member having a uniform original wall thickness along the entire length thereof;

progressively heating a portion of said member in a first direction at a speed W to an upsetting temperature, while compressing said member between a first stationary anvil and a second anvil moving at a speed V in a direction opposite to said first direction, thereby upsetting the heated portion of said member resulting in a thickened wall portion;

cooling said thickened wall portion progressively to a temperature below said upsetting temperature, thereby setting said thickened wall portion;

wherein as said heated portion becomes initially upset, the ratio V/W is gradually increased to and maintained at, a maximum value, such that the wall of said heated portion is progressively thickened to and maintained at a maximum thickness of more than 1.4 times the original wall thickness in a direction from said first anvil to said second anvil.

2. The method of claim 1, and further including the step of gradually decreasing said ratio V/W after the maximum wall thickness has been attained, such that the wall of said heated portion decreases in thickness from its maximum thickness to its original thickness in a direction from the point at which the wall has its maximum thickness towards said second anvil.

3. The method of claim 1, wherein said progressively heating step includes supplying a quantity of heat per unit time to said metallic member, and further comprising the step of adjusting said quantity of heat supplied per unit time to said metallic member such that said quantity of heat supplied per unit time to said metallic member remains constant per unit length of said metallic member during said progressively heating step.

4. The method of claim 1, wherein said progressively heating step includes supplying a quantity of heat per unit time to said metallic member, and further comprising the step of:

adjusting said quantity of heat supplied per unit time to said metallic member such that said quantity of heat supplied per unit time to said metallic member remains constant per unit length of said metallic member during said progressively heating step, and such that the temperature of the heated portion is maintained at a desired level.

5. A method of forming a structural element, comprising the steps of:

preparing a column having at least one thickened wall portion defined in an axial portion of the column by the method comprising the steps of:

providing an elongated metallic member having a uniform original wall thickness along the entire length thereof;

progressively heating a portion of said member in a first direction at a speed W to an upsetting temperature, while compressing said member between a first stationary anvil and a second anvil moving at a speed V in a direction opposite to said first direction, thereby upsetting the heated portion of said member resulting in a thickened wall portion;

cooling said thickened wall portion progressively to a temperature below said upsetting temperature, thereby setting said thickened wall portion;

wherein as said heated portion becomes initially upset, the ratio V/W is gradually increased to and maintained at, a maximum value, such that the wall of said heated portion is progressively thickened to and maintained at a maximum thickness of more than 1.4 times the original wall thickness in a direction from said first anvil to said second anvil, thereby forming said metallic member into a column having a thickened wall portion; and providing a skeleton beam having two ends; and connecting one of said ends of said skeleton beam to the thickened wall portion of said column.

6. The method of claim 5, wherein said connecting step comprises bolting said one end of the skeleton beam to said thickened wall portion of the column.

7. The method of claim 5, wherein said connecting step comprises welding said one end of the skeleton beam to said thickened wall portion of the column.

8. The method of claim 5, wherein said column is tubular, and further comprising the step of filling concrete into said column.

9. The method of claim 5, wherein said skeleton beam is H-shaped and comprises two parallel flanges interconnected by a web perpendicular thereto, and further comprising the steps of:

performing each of a steps b), c) and d) successively a second time such that said metallic member is formed into a column having two thickened wall portions spaced from one another by an unthickened wall portion; and connecting each of said flanges to a respective one of said thickened wall portions, such that said web spans said unthickened wall portion.

10. The method of claim 1, wherein said maximum wall thickness is no greater than 3.6 times the original wall thickness.

* * * * *